US008162705B2

(12) United States Patent
Koide et al.

(10) Patent No.: US 8,162,705 B2
(45) Date of Patent: Apr. 24, 2012

(54) WATER JET PROPULSION WATERCRAFT

(75) Inventors: Shinobu Koide, Shizuoka (JP); Masaki Takegami, Shizuoka (JP); Kohei Terada, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 356 days.

(21) Appl. No.: 12/566,745

(22) Filed: Sep. 25, 2009

(65) Prior Publication Data

US 2010/0081347 A1 Apr. 1, 2010

(30) Foreign Application Priority Data

Sep. 26, 2008 (JP) ..... 2008-248077

(51) Int. Cl.
*B63H 11/00* (2006.01)

(52) U.S. Cl. ..... 440/38; 440/83

(58) Field of Classification Search ..... 440/38, 440/83

See application file for complete search history.

(56) References Cited

U.S. PATENT DOCUMENTS

| | | | | |
|---|---|---|---|---|
| 5,405,276 | A * | 4/1995 | Kato | 440/38 |
| 2003/0015128 | A1 | 1/2003 | Gokan et al. | |
| 2003/0140889 | A1 | 7/2003 | Matsuda | |
| 2004/0194682 | A1 | 10/2004 | Matsuda | |
| 2006/0205293 | A1 * | 9/2006 | Fuse | 440/83 |

* cited by examiner

*Primary Examiner* — Stephen Avila
(74) *Attorney, Agent, or Firm* — Keating & Bennett, LLP

(57) ABSTRACT

A water jet propulsion watercraft includes, a main engine body, a rotor chamber provided at a rear portion of the main engine body, a crankshaft arranged such that a rear end portion of the crankshaft is disposed in the rotor chamber, the rear end portion having a first connection portion, an output shaft having a second connection portion at a front end of the output shaft, the second connection portion arranged to be connected to the first connection portion of the crankshaft such that the output shaft rotates together with the crankshaft about a rotational center axis of the crankshaft, a rotor unit housed in the rotor chamber and fixed to the output shaft, a fastening member arranged to fasten the first connection portion and the second connection portion, a drive shaft connected to a rear end portion of the output shaft.

20 Claims, 11 Drawing Sheets

WATER JET PROPULSION WATERCRAFT

BACKGROUND OF THE INVENTION

1. Field of the Invention

The present invention relates to a water jet propulsion watercraft including a jet unit (jet propulsion device) having an engine (internal combustion engine) as a drive source.

2. Description of the Related Art

An example of a water jet propulsion watercraft is disclosed in US 2004/0194682 A1. This water jet propulsion watercraft includes a hull, a water jet pump, and an engine. The engine applies a driving force to the water jet pump. The water jet pump includes a propeller shaft rotated by the driving force of the engine, and an impeller coupled to the propeller shaft. By rotation of the propeller shaft, water is sucked in from a hull bottom and the water is jetted rearward by the impeller. A propulsive force is thereby applied to the hull.

The engine has a crankcase at a lower side. A crankshaft housed in the crankcase is extended to a rear of the crankcase. An extended axial member is coupled to a rear end of the crankshaft. The propeller shaft is coupled to the extended axial member via a coupling.

A housing is disposed at the rear of the crankcase. The crankshaft is coupled to the extended axial member inside the housing. A power generator, which is a heavy object, is disposed inside the housing. A center of gravity of the water jet propulsion watercraft can thereby be positioned at the rear.

To dispose the power generator at the rear of the crankcase, a space arranged to dispose the power generator between the crankcase and the coupling must be secured. The extended axial member is provided between the crankshaft and the coupling to secure this space.

More specifically, a rear end portion of the crankshaft has a tapered shape portion, and further to the rear thereof, a male screw is coaxial to a rotational center axis of the crankshaft. A female screw, engageable with the male screw, is formed at a front end portion of the extended axial member.

According to the water jet propulsion watercraft, the impeller receives a load from water in a direction opposite a rotational direction of the impeller (and the crankshaft) during propulsion on water. The screws are arranged so that when the load received by the impeller is applied via the extended axial member to the engagement portions of the crankshaft and the extended axial member, the engagement portions are tightened to each other by the load. The engagement portions of the crankshaft and the extended axial member are thereby prevented from loosening during propulsion on water. Also, by the fastening of the crankshaft and the extended axial member, vibration is prevented from occurring between the crankshaft and the extended axial member.

SUMMARY OF THE INVENTION

The inventors of the present invention described and claimed in the present application conducted an extensive study and research regarding a water jet propulsion watercraft, such as the one described above, and in doing so, discovered and first recognized new unique challenges and problems as described in greater detail below.

For maintenance after use, a user of the water jet propulsion watercraft races the engine on land. Water inside the hull can thereby be eliminated. Unlike on water, a load due to water is not applied to the impeller during the racing on land. Thus, when the user performs rapid closing of the accelerator from a state where it is open, the crankshaft decreases sharply in rotational speed. Consequently, a rotational direction force (load) is applied to the extended axial member due to a rotational inertial force of the impeller, the drive shaft, and the extended axial member. Thus, according to the arrangement of the conventional art described above, there is a possibility of loosening of the engagement portions of the extended shaft member and the crankshaft.

According to a conventional water jet propulsion watercraft of low maximum output, a load large enough to cause loosening of the engagement portions of the extended axial member and the crankshaft does not occur because the impeller, the drive shaft, and the extended axial member are small and the rotational inertial force of these members is small. The above problem of loosening was thus not clearly manifested. However, water jet propulsion watercrafts are recently becoming high in maximum output and the impeller, the drive shaft, and the extended axial member are becoming large. Consequently, the load that acts on the engagement portions of the extended axial member and the crankshaft during racing on land is becoming greater. As a result of extensive study of such increase of load, the present inventors found that there is a need to prevent the loosening of the engagement portions of the extended axial member and the crankshaft more reliably.

In order to overcome the previously unrecognized and unsolved problems described above, a preferred embodiment of the present invention provides a water jet propulsion watercraft that includes a main engine body, a rotor chamber provided at a rear portion of the main engine body, a crankshaft arranged such that a rear end portion of the crankshaft is disposed in the rotor shaft chamber, the rear end portion having a first connection portion, an output shaft including a second connection portion at a front end portion of the output shaft, the second connection portion arranged to be connected to the first connection portion of the crankshaft such that the output shaft rotates together with the crankshaft about a rotational center axis of the crankshaft, a rotor unit housed in the rotor chamber and fixed to the output shaft, a fastening member arranged to fasten the first connection portion and the second connection portion along a fastening axis that differs from the rotational center axis, a drive shaft connected to a rear end portion of the output shaft and arranged to be rotated together with the output shaft, and a jet propulsion unit, including an impeller coupled to the drive shaft and arranged to suck in and jet out water.

The fastening axis refers to a straight line arranged to extend along a fastening direction in which the fastening member fastens the first connection portion and the second connection portion. The fastening axis that differs from the rotational center axis refers inclusively to cases where the fastening axis and the rotational center axis are in a parallel, intersecting, or twisted relationship.

According to this water jet watercraft, when the engine is raced on land where a load due to water is not applied to the impeller, the crankshaft decreases sharply in rotational speed with rapid closing of an accelerator. Consequently, a rotational direction force (load) is applied to the drive shaft and the output shaft due to a rotational inertial force of the impeller and the drive shaft. The rotational direction load acts about the rotational center axis of the crankshaft. The fastening axis of the fastening member differs from the rotational center axis. Thus, even when the crankshaft receives a load in a first rotational direction or a load in a second rotational direction, the fastening member can receive a force due to relative rotation of the first connection portion and the second connection portion (for example, a shear force). According to such a fastening member, changing of a fastening force of the fastening member according to the rotational direction load can be prevented. Loosening of the output shaft with respect to the crankshaft can thereby be prevented. Moreover, the occurrence of vibration between the crankshaft and the output shaft can be prevented because the crankshaft and the output shaft are fastened by the fastening member.

Preferably, the fastening member has a shaft portion that receives the shear force due to the relative rotation of the first connection portion and the second connection portion. In this case, the axial portion receives the shear force by a reaction force due to contact with the first connection portion in the relative rotational direction of the first connection portion and the second connection portion and receives the shear force by a reaction force due to contact with the second connection portion. The axial portion can thus connect the first connection portion and the second connection portion by the reaction forces due to contact in the rotational direction in addition to frictional forces. The first connection portion and the second connection portion can thus be connected more firmly.

For example, the fastening member may be a screw member arranged to have a screw shaft centered at the fastening axis. In this case, the screw shaft of the screw member corresponds to the axial portion that receives the shear force. A center axis of the screw shaft is the fastening axis of the screw member. The fastening axis of the screw member that fastens the crankshaft and the output shaft differs from the rotational center axis. The rotational direction load can thus be prevented from acting as a force that makes the screw member rotate about its fastening axis. Rotation of the screw member in a loosening manner can thereby be prevented and loosening of the output shaft with respect to the crankshaft can thus be prevented.

Besides the above, a rivet, a coupling, a fastening pin or other fastening member having a fastening axis that differs from the rotational center axis of the crankshaft can be the fastening member. In a case where the fastening member is a rivet, the fastening axis is a center axis of an axial portion of the rivet.

The rotor chamber is disposed at the rear portion of the main engine body and the rotor unit is disposed inside the rotor chamber. A center of gravity of the water jet propulsion watercraft can thereby be disposed toward the rear. Consequently, an improvement can be made to motion performance (mainly, turning performance) of the water jet propulsion watercraft.

According to the present water jet propulsion watercraft, both connection of the crankshaft and the output shaft and connection of the crankshaft and the rotor unit can be achieved in a single step of connecting the output shaft, to which the rotor unit is fixed, to the crankshaft. For example, in an arrangement where the rotor unit is directly attached to the crankshaft, the two steps including a first step of attaching the rotor unit to the crankshaft and a second step of attaching the output shaft to the crankshaft are required and this is troublesome. Moreover, in a process of fixing the rotor unit to the crankshaft, the main engine body that houses a large portion of the crankshaft is an obstacle and the process is thus difficult to perform. In contrast, according to the arrangement of the present preferred embodiment, the work of fixing the rotor unit can be performed easily because the rotor unit can be fixed in advance to the output shaft before attaching the output shaft to the crankshaft.

As a result of making the rotational center axis of the crankshaft and the fastening axis of the fastening member different, loosening between the crankshaft and the outputs shaft can be prevented regardless of a magnitude of a rotational inertial force that is transmitted to the crankshaft from the rotor unit via the output shaft. The rotor unit may thus be large in weight and the rotor unit can thus be made high in degree of freedom of design.

The rotor unit may be a flywheel unit that is fixed to the output shaft and stabilizes the rotation of the crankshaft by being arranged to be rotated together with the crankshaft. By this arrangement, the flywheel unit, which is a heavy object, can be connected readily and in a stable state to the crankshaft by being arranged to fix the output shaft, to which the flywheel unit is fixed, to the crankshaft.

The rotor unit may be a rotor unit of a power generator that generates electricity by a driving force of the engine. The rotor unit is combined with a stator unit to define the power generator. The rotor unit may also serve the role of the flywheel unit as well.

Besides the above, the rotor unit may be a gear unit, to which a driving force from a starter motor (self-starting motor) is transmitted (preferably transmitted via a one-way clutch). Or, the rotor unit may be a gear unit that transmits the driving force of the engine to a supercharger. Yet further, the rotor unit may be a sprocket engaged to a cam chain that transmits power to a cam that drives an air intake valve and an exhaust valve. Besides the above, a rotating member that is to be rotated by the driving force of the engine can be the rotor unit.

In a preferred embodiment of the present invention, the second connection portion of the output shaft includes a flange portion arranged to contact the first connection portion of the crankshaft. By this arrangement, the output shaft and the crankshaft can readily be fastened in a disposition where the rotational center axis of the crankshaft and the fastening axis of the fastening member differ.

In a preferred embodiment of the present invention, the rotor unit is fixed to the flange portion of the output shaft. By this arrangement, the rotor unit can be rotated with the rotation of the output shaft. The flange portion of the output shaft can be connected to both the first connection portion of the crankshaft and to the rotor unit. In this case, the output shaft does not have to have a separate flange portion for connection to the crankshaft and a separate flange for connection to the rotor unit, and the output shaft can thus be made short. The rotor unit, which is a heavy object, can be readily fixed in a stable state to the output shaft by the flange portion.

In a preferred embodiment of the present invention, the first connection portion of the crankshaft includes a flange portion arranged to contact the flange portion of the output shaft. By this arrangement, the crankshaft and the output shaft can be fastened readily by being arranged to fasten together the flange portion of the crankshaft and the flange portion of the output shaft by the fastening member.

Preferably in this case, a stator unit arranged to surround an outer peripheral portion of the crankshaft inside the rotor chamber and disposed so as to overlap with the flange portion of the crankshaft when viewed from a direction that is perpendicular or substantially perpendicular to the crankshaft, and a rotor unit fixed to the flange portion of the output shaft, and arranged to extend to the crankcase side of the main engine body, and to cover an outer peripheral portion of the stator unit, are further included.

By this arrangement, the crankshaft can be made short in a fore-and-aft direction because the stator unit and the flange portion of the crankshaft are disposed so as to be overlapped. By being arranged to surround the periphery of the stator unit with the rotor unit, the rotor unit can be made to oppose the stator unit. A power generator that generates electric power by a magnetic interaction of the stator unit and the rotor unit can thereby be arranged.

Preferably in this case, the rotor unit is fastened to the flange portion of the output shaft. By this arrangement, the rotor unit can be rotated with the rotation of the output shaft. The flange portion of the output shaft can also be connected to both the first connection portion of the crankshaft and the rotor unit. The output shaft can thereby be made short because the output shaft does not have to have a separate flange portion for connection to the crankshaft and a separate flange for connection to the rotor unit. The rotor unit, which is a heavy object, can be fixed in a stable state to the output shaft by the flange portion.

In a water jet propulsion watercraft according to a preferred embodiment of the present invention, a plurality of the fastening members are disposed along a circumference of predetermined radius, centered on the rotational center axis of the crankshaft, and spaced apart at predetermined intervals. By this arrangement, the output shaft can be fastened firmly with respect to the crankshaft and yet uniformly around the rotational center axis. Moreover, the output shaft is fastened to the crankshaft at positions spaced away from the rotational center axis, and relative rotation of the crankshaft and the output shaft can thus be restricted more reliably by the fastening members. The rotation of the crankshaft can thus be transmitted reliably to the output shaft. Also, in a case where the rotor unit is a flywheel unit, its rotation due to inertia can be transmitted reliably to the crankshaft. Rotation of the crankshaft during idling of the engine, etc., can thereby be stabilized.

In a preferred embodiment of the present invention, a screw hole is provided in the first connection portion of the crankshaft, a screw insertion hole is provided in the second connection portion of the output shaft, and the fastening member includes a screw member arranged to pass through the screw insertion hole and to be threadedly fixed in the screw hole. By this arrangement, the process of fastening the output shaft to the crankshaft can be performed from an outer side (rear side) of the main engine body. The output shaft can thus be fastened firmly and uniformly to the crankshaft by an easily-performed work.

A preferred embodiment of the present invention further includes a positioning structure, disposed at a position spaced at a predetermined distance from the rotational center axis of the crankshaft arranged to restrict relative rotations of the first connection portion and the second connection portion about the rotational center axis to set a position of the output shaft with respect to the crankshaft. By this arrangement, positioning of the output shaft in the rotational direction with respect to the crankshaft can be performed. The rotation of the crankshaft can thus be transmitted more reliably to the output shaft. In the case where the rotor unit is the flywheel unit, its rotation due to inertia can be transmitted to the crankshaft reliably.

A preferred embodiment of the present invention further includes a recessed portion provided on one of the rear end portion of the crankshaft and the front end portion of the output shaft, and a protruding portion provided on the other one of the rear end portion of the crankshaft and the front end portion of the output shaft and arranged to fit with the recessed portion, and central axes of the recessed portion and the protruding portion are matched with the rotational center axis. By this arrangement, the output shaft and the crankshaft can be disposed coaxially by fitting of the protruding portion and the recessed portion. The protruding portion can be fitted in the recessed portion before a work of fastening the output shaft and crankshaft by the fastening member. Circumferential direction positions of the crankshaft and the output shaft can thereby be adjusted in a state where the output shaft and the crankshaft are disposed coaxially. The crankshaft and the output shaft can thereafter be fastened by the fastening member. A work of assembling together the output shaft and the crankshaft can thereby be performed readily because there is no need to attach the fastening member in a state where a worker supports the heavy output shaft.

A preferred embodiment of the present invention further includes, a stator unit arranged to surround an outer peripheral portion of the crankshaft inside the rotor chamber, and the main engine body includes a crankcase arranged to house a portion of the crankshaft, and the stator unit is attached to the crankcase of the main engine body. By this arrangement, assembly of the water jet propulsion watercraft is facilitated. For example, in a case where the stator unit is attached to a cover that covers the rotor chamber, the stator unit is drawn towards a magnet of the rotor unit during attachment of the cover to the crankcase side. It is thus difficult to attach the cover to the crankcase side. In contrast, according to the above-described arrangement, the stator unit is attached to the crankcase and there is thus no need to attach the stator unit to a cover that covers the rotor chamber. The cover can thus be attached to the crankcase side with ease.

A preferred embodiment of the present invention further includes, a starter motor arranged to be driven when the engine is started, a first gear arranged to output a driving force of the starter motor, a second gear coupled to the first gear in a manner enabling constant transmission of power and arranged to transmit the driving force of the starter motor to the output shaft, and a one-way clutch disposed between the output shaft and the second gear and arranged to make the second gear run idle with respect to the output shaft such that the driving force of the output shaft is not transmitted to the second gear while the engine is running. By this arrangement, during starting of the engine, the driving force of the starter motor is transmitted to the crankshaft via the first gear, the second gear, and the one-way clutch. The engine is thereby started. On the other hand, while the engine is running, the one-way clutch does not transmit the rotation of the crankshaft to the second gear.

In U.S. Patent Application Publication 2004/0194682 A1 a structure is described as operating such that, during the starting of the engine, gears that transmit the driving force of a starter motor are mutually engaged and the mutual engagement of these gears is disengaged after completion of the starting of the engine. However, according to this structure, the gears and the motor become damaged readily because the mutual engagement and disengagement of the gears are repeated. In contrast, according to the arrangement described above, even though the engagement between gears is not disengaged, the driving force of the engine is not transmitted to the stator motor side by the function of the one-way clutch after completion of the starting of the engine. A highly reliable structure with a low occurrence of malfunction can thus be provided.

In this case, the second connection portion of the output shaft includes a flange portion having a front end that is arranged to contact the first connection portion of the crankshaft, and the one-way clutch is fixed to a rear surface of the flange portion of the output shaft. By this arrangement, the one-way clutch can be attached firmly and readily to the flange portion of the output shaft from the outer side (rear side) of the main engine body. From another viewpoint, a rotating member at the flange portion side of the one-way clutch is an example of a rotor unit that is fixed to the flange portion.

Preferably, the second gear is rotatably supported on the output shaft at the rear relative to the flange portion of the output shaft. The one-way clutch includes a first rotating member at the flange portion side and a second rotating member at the second gear side and is arranged to transmit a relative rotation of the second rotating member with respect to the first rotating member in a first direction and not transmit the relative rotation in the other direction. While the engine is running, the second gear runs idle about the crankshaft.

The stator unit, which, as mentioned above, makes up the power generator together with the rotor unit that is fixed to the flange portion of the output shaft, can be supported on the main engine body (for example, the crankcase) at the front relative to the flange portion of the crankshaft. There is thus no need to secure a space for positioning the stator unit at the rear relative to the flange portion of the output shaft. The space inside the rotor chamber can thus be utilized effectively to compactly house the stator unit and the second gear. Moreover, workability during attachment of the cover of the rotor chamber can be improved as mentioned above.

Preferably in this case, the crankshaft includes a first oil passage portion through which oil flows, and the output shaft includes a second oil passage portion connected to the first oil passage portion and arranged to supply the oil to the one-way clutch. By this arrangement, the oil can be supplied to the one-way clutch with ease. For example, the oil can be supplied to the one-way clutch by being arranged to supply the oil to the oil passage from the main engine body side.

In a water jet propulsion watercraft according to a preferred embodiment of the present invention, the fastening member is arranged to fasten the first connection portion and the second connection portion in a fastening direction that intersects the rotational center axis of the crankshaft.

By this arrangement, as a result of the fastening axis of the fastening member extending in the fastening direction that intersects the rotational center axis and differing from the rotational center axis of the crankshaft, the loosening of the output shaft with respect to the crankshaft can be prevented as described above.

Preferably in this case, the fastening direction is substantially perpendicular to the rotational center axis of the crankshaft. By this arrangement, the output shaft and the crankshaft are fastened in a direction substantially perpendicular to the rotational center axis. The fastening member can thereby be used as a retaining member that prevents the output shaft and the crankshaft from moving in directions of separating along the rotational center axis.

In a water jet propulsion watercraft according to a preferred embodiment of the present invention, the first connection portion and the second connection portion overlap when viewed from a direction perpendicular or substantially perpendicular to the crankshaft, and the fastening member is arranged to fasten the overlapping portions of the first connection portion and the second connection portion to each other. By this arrangement, the crankshaft and the output shaft can be fastened readily in the direction intersecting the rotational center axis.

Preferably in this case, the crankshaft includes an oil passage portion provided along the rotational center axis, the fastening member includes a screw member, the second connection portion of the output shaft includes a bearing surface portion arranged to receive the screw member, and a screw insertion hole opening at the bearing surface portion, the first connection portion of the crankshaft includes a screw hole arranged to engage with the screw member passing through the screw insertion hole, and a tip portion of the screw member is arranged so as not to reach the oil passage portion. By this arrangement, clogging of the oil passage portion by the screw member can prevented. Reduction of a flow amount of the oil in the oil passage portion can thereby be prevented.

Preferably in the water jet propulsion watercraft where the screw member fastens the overlapping portions of the first connection portion and the second connection portion to each other, one of either of the first connection portion and the second connection portion includes a recessed portion, the other of the first connection portion and the second connection portion includes a protruding portion arranged to fit with the recessed portion, and the recessed portion and the protruding portion are fitted together along the rotational center axis. By this arrangement, the first connection portion and the second connection portion can be fitted so as to overlap when viewed from a direction perpendicular or substantially perpendicular to the crankshaft, and the overlapping portions can be fastened readily by the fastening member.

Further, by being arranged to fit together the recessed portion and the protruding portion, the output shaft and the crankshaft can be fitted in a coaxial state at a point prior to fastening the first connection portion and the second connection portion by the fastening member. The fastening member can thus be attached without having to manually support the output shaft. That is, the screw member does not have to be attached while manually supporting the output shaft, to which the heavy rotor unit is fixed, and positioning the output shaft with respect to the crankshaft. The work of installing the output shaft onto the crankshaft can thereby be performed readily.

Preferably in this case, the protruding portion has an outer peripheral surface having a polygonal shape when viewed from a direction extending along the rotational center axis, and the recessed portion has inner peripheral surface having a polygonal shape arranged to engage with the outer peripheral surface of the protruding portion when viewed from the direction extending along the rotational center axis. By this arrangement, the protruding portion and the recessed portion can be engaged so as not to run idle with respect to each other. The rotational force of the crankshaft can thus be transmitted to the output shaft. Transmission of power from the crankshaft to the output shaft via the engagement of the recessed portion and the protruding portion can thereby be performed in addition to the transmission of power from the crankshaft to the output shaft via the fastening member. A load received by the fastening member during transmission of the rotation of the crankshaft to the output shaft can thereby be reduced, and the durability of the fastening member can thus be improved.

Preferably, the water jet propulsion watercraft, where the fastening member connects the first connection portion and the second connection portion in the fastening direction that intersects the rotational center axis of the crankshaft, further includes a flange member disposed at an outer peripheral surface portion of the output shaft inside the rotor chamber and to which the rotor unit is attached, and a flange fastening member arranged to fasten the flange member to the output shaft, and the flange fastening member is arranged to fasten the flange member and the output shaft along a direction directed from the outer peripheral surface portion to the rotational center axis. By this arrangement, the flange member can be fastened readily to the output shaft in a direction perpendicular or substantially perpendicular to the rotational center axis by the flange fastening member.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
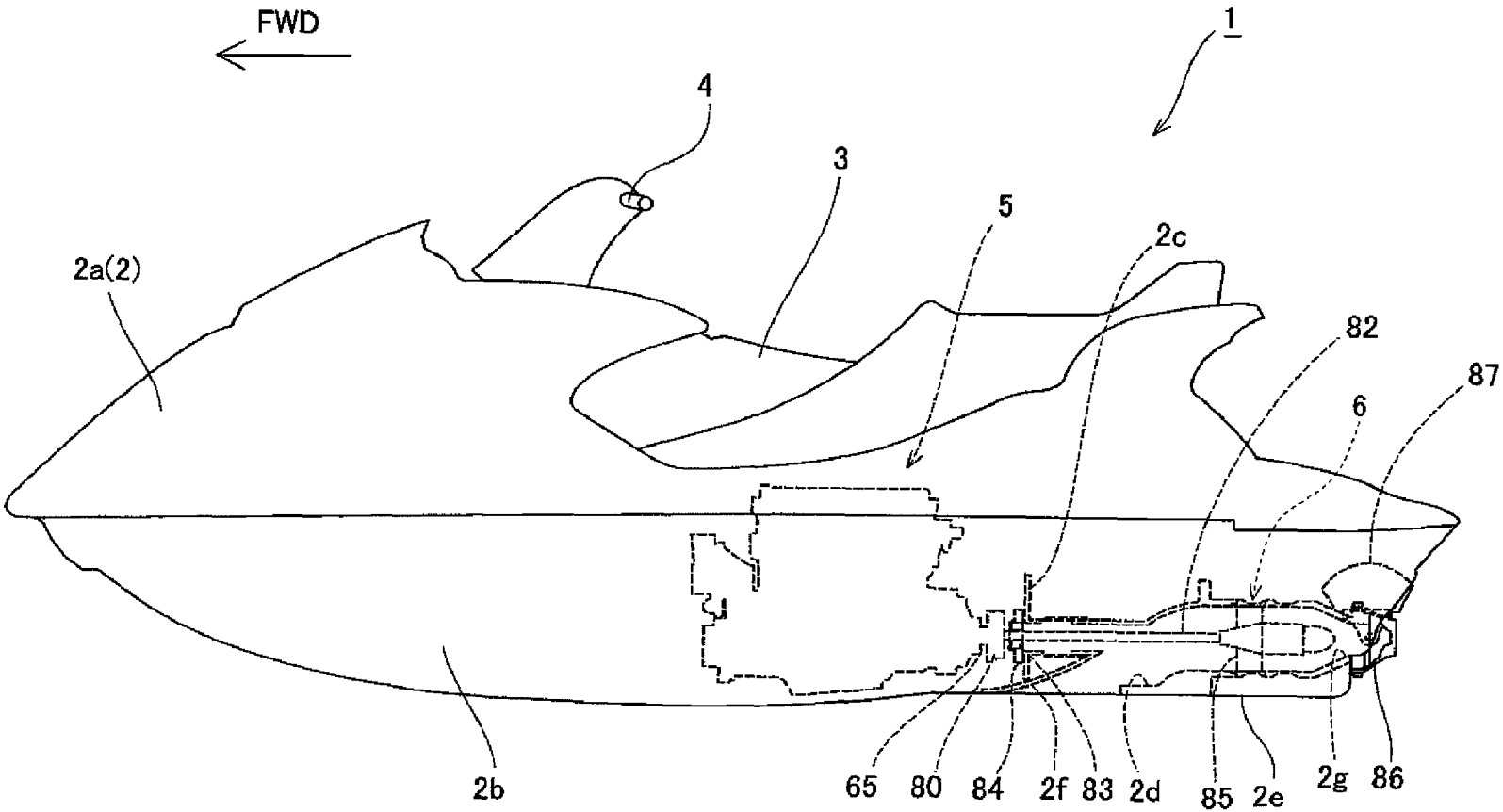
FIG. 1 is a side view of an overall arrangement of a water jet propulsion watercraft according to a first preferred embodiment of the present invention.

FIG. 1 is a side view of an overall arrangement of a water jet propulsion watercraft according to a first preferred embodiment of the present invention.

The water jet propulsion watercraft 1 of the preferred embodiment includes a hull 2, a seat 3, a steering apparatus 4, an engine 5, and a jet propulsion unit 6. The hull 2 includes a deck 2*a* and a hull body 2*b*. The seat 3 is disposed on an upper portion of the hull 2. The steering apparatus 4 for steering the hull 2 is disposed in front of the seat 3. The engine 5 is disposed in an engine room in an interior of the hull 2. The jet propulsion unit 6 is disposed at the rear of the engine 5 inside the hull body 2*b*.

Figure 2:
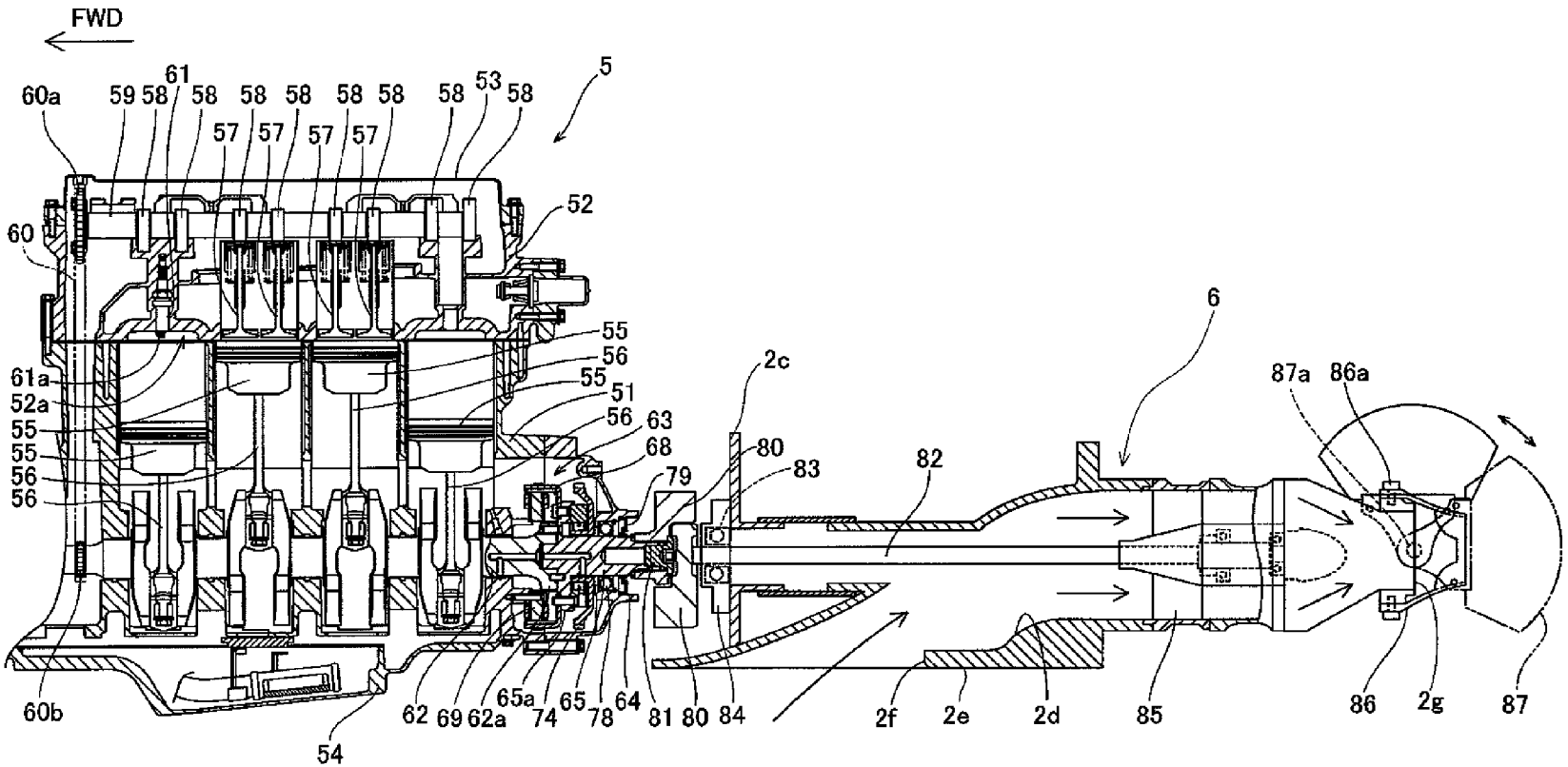
FIG. 2 is a sectional view for describing an arrangement of an engine and a periphery of a drive shaft of the water jet propulsion watercraft according to the first preferred embodiment of the present invention.

FIG. 2 is an enlarged sectional view of the engine 5 and the jet propulsion unit 6. The jet propulsion unit 6 includes a drive shaft 82, an impeller 85, a deflector 86, and a reverse bucket 87. An output shaft 65, connected to a crankshaft 62, protrudes from a rear portion of the engine 5 and a coupling 80 is attached to a rear end of the output shaft 65. At the rear of the coupling 80, the drive shaft 82 is disposed so as to extend rearward. The drive shaft 82 is supported by a bearing 83 attached to a bulkhead 2*c* of the hull 2. The bearing 83 is covered by a sealing member 84 and is arranged to prevent inflow of water into the engine room. The impeller 85 is attached to a rear portion of the drive shaft 82. The impeller 85 is fixed to the drive shaft 82 and is arranged to rotate together with the drive shaft 82. The impeller 85 is also disposed in a water passage portion 2*d* formed at a lower portion of the hull 2 and has functions of drawing up water from a water inflow portion 2*f* of a hull bottom 2*e* and jetting out water from a water discharging portion 2*g* at a rear portion of the hull 2. The deflector 86, which controls a water jetting direction by converting the direction to the left and right, is attached to the water discharging portion 2*g*. The deflector 86 is arranged to be rotatable in left and right directions about an axial portion 86*a* in linkage with the steering apparatus 4 (see FIG. 1). The reverse bucket 87, which reverses the direction of water jetted from the water discharging portion 2*g* to an FWD arrow direction side during reverse drive, is attached to the water discharging portion 2*g*. The reverse bucket 87 is arranged to be rotatable in up and down directions about an axial portion 87*a*. The reverse bucket 87 is disposed at a position at which it is sprung upward during forward drive, and is disposed at the rear of the water discharging portion 2*g* during reverse drive.

Figure 3:
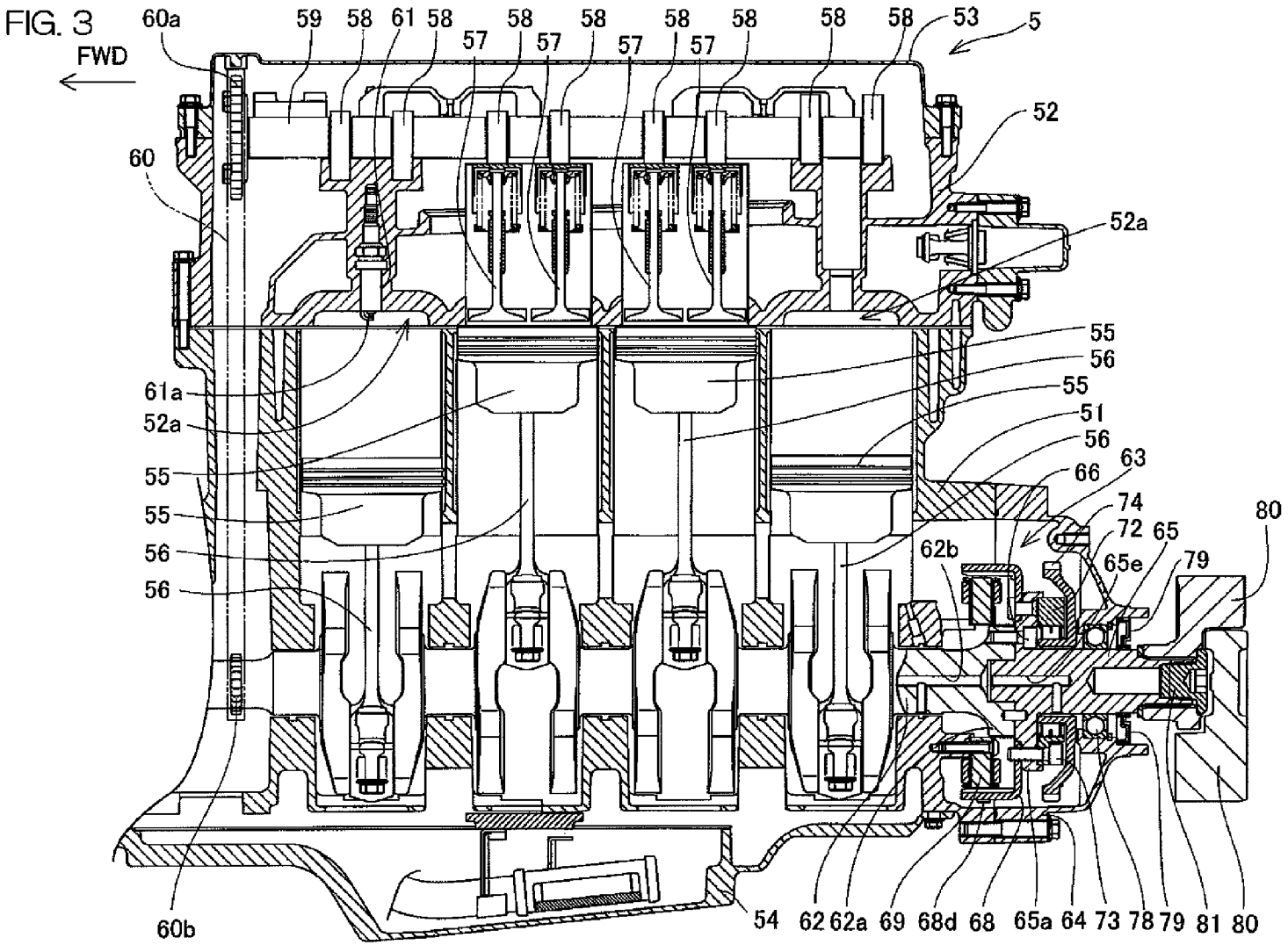
FIG. 3 is a sectional view of the engine of the water jet propulsion watercraft according to the first preferred embodiment of the present invention.

FIG. 3 is a further enlarged sectional view of the arrangement of the engine 5. The engine 5 includes a cylinder body 51, a cylinder head 52, a cylinder head cover 53, and a crankcase 54 that houses the crankshaft 62. Each of the cylinder body 51, the cylinder head 52, the cylinder head cover 53, and the crankcase 54 is an example of a "main engine body" according to a preferred embodiment of the present invention. The cylinder body 51 has pistons 55 disposed therein in a manner enabling sliding along its inner peripheral surface. An upper end of a connecting rod 56 is rotatably attached to each piston 55. The cylinder head 52 is disposed so as to close an opening at one side of the cylinder body 51. Air intake valves 57 and exhaust valves (not shown) are disposed in the cylinder head 52. Cams 58 and a camshaft 59 are further disposed in the cylinder head 52. The cams 58 move the air intake valve 57 and the exhaust valve (not shown) at predetermined timings. The camshaft 59 rotates the cams 58. A chain 60 is disposed at a front end side of the camshaft 59.

Specifically, a sprocket 60*a* is disposed at the front end side of camshaft 59, and the chain 60 is engaged with the sprocket 60*a*. The chain 60 is engaged with a sprocket 60*b* fixed to a front end portion of the crankshaft 62. The chain 60 is thus driven with the rotation of the crankshaft 62. That is, the camshaft 59 is arranged to be rotated by the crankshaft 62 being rotated.

Ignition plugs 61 are disposed in the cylinder head 52. A tip end 61*a* of each ignition plug 61 is disposed to protrude into a combustion chamber 52*a* defined by the cylinder body 51, the cylinder head 52, and the piston 55. The cylinder head cover 53 is attached to the cylinder head 52 so as to cover the camshaft 59.

Also, the cylinder body 51 is attached to the crankcase 54. The crankshaft 62 is supported in a state of being sandwiched between the cylinder body 51 and the crankcase 54. Lower ends of the connecting rods 56 are rotatably attached to the crankshaft 62. The crankshaft 62 is thereby arranged to be rotated with the pistons 55 being slid up and down. The sprocket 60*b* is fixed to a front side (FWD arrow direction side) portion of the crankshaft 62. The chain 60 is further engaged with the sprocket 60*b*.

An auxiliary machinery chamber 63 is disposed at a rear portion of the cylinder body 51 and the crankcase 54. A stator unit 69 and a rotor unit 68, to be described later, and other auxiliary machinery are disposed inside the auxiliary machinery chamber 63. Specifically, the auxiliary machinery chamber 63 is formed of a rear end portion of the cylinder body 51, a rear end portion of the crankcase 54, and a cover member 64 and has a housing space in its interior. The cover member 64 covers the rear end portion of the cylinder body 51 and the rear end portion of the crankcase 54. The auxiliary machinery chamber 63 is an example of a "rotor chamber" according to a preferred embodiment of the present invention and the cover member 64 is an example of a "main engine body" according to a preferred embodiment of the present invention. "Auxiliary machinery" refers to auxiliary machinery accessory to the engine 5, which is the main machinery.

Figure 4:
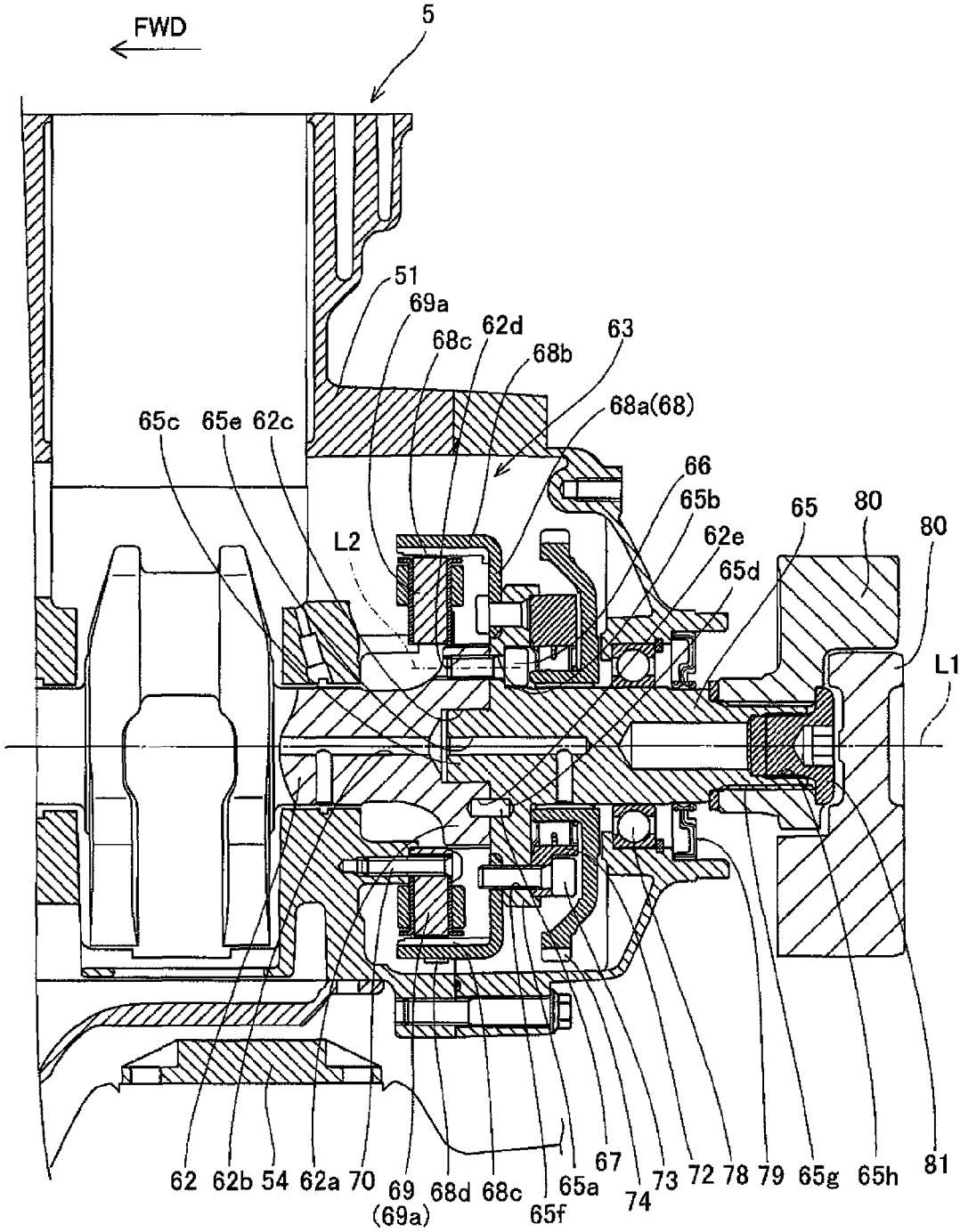
FIG. 4 is a sectional view of a vicinity of an auxiliary machinery chamber of the engine of the water jet propulsion watercraft according to the first preferred embodiment of the present invention.

FIG. 4 is a further enlarged sectional view of the arrangement of a vicinity of the auxiliary machinery chamber 63. A rear portion of the crankshaft 62 protrudes from the crankcase 54 and is housed in the auxiliary machinery chamber 63. A flange portion 62*a* is formed at a rear end portion of the crankshaft 62. The flange portion 62*a* is disposed inside the auxiliary machinery chamber 63. The flange portion 62*a* is an example of a "rear end portion of the crankshaft," a "first connection portion of the crankshaft," and a "flange portion of the crankshaft" according to a preferred embodiment of the present invention. In the crankshaft 62, an oil passage portion 62*b* is formed along a rotational center axis L1 of the crankshaft 62. The oil passage portion 62*b* is an example of a "first oil passage portion" according to a preferred embodiment of the present invention. A recessed portion 62*c* is formed along the rotational center axis L1 at the rear end portion of the crankshaft 62. A protruding portion 65*c*, formed on a front end portion of the output shaft 65 is fitted in the recessed portion 62*c*. Central axes of the flange portion 62*a* and a flange portion 65*a* are matched with the rotational center axis L1.

Figure 5:
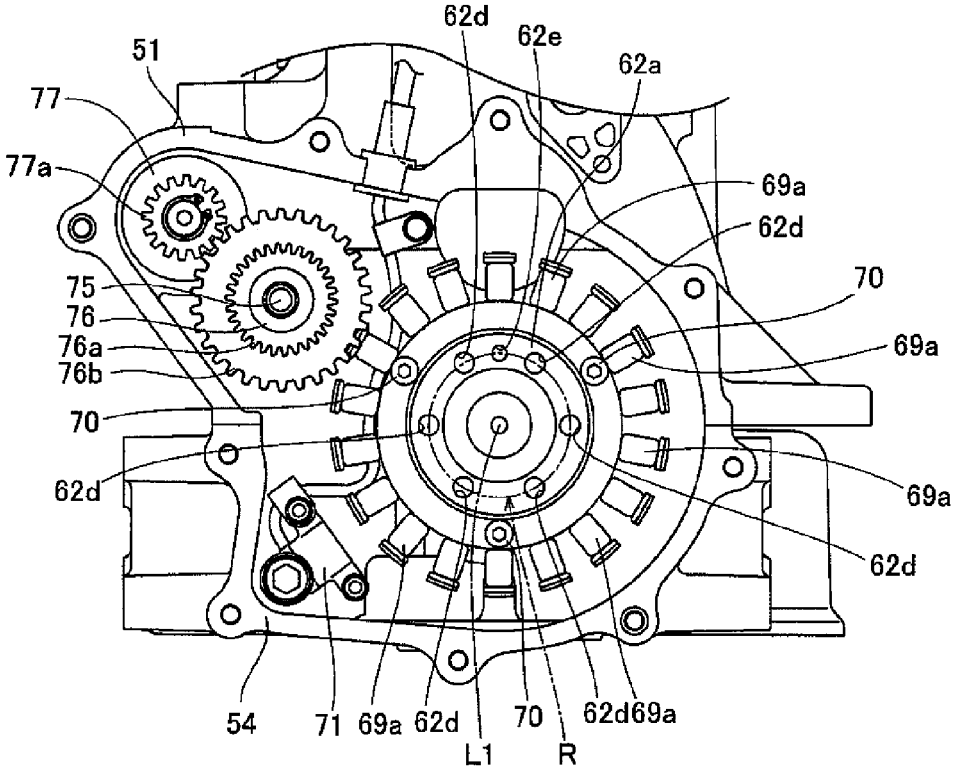
FIG. 5 is a diagram of a state where a stator unit is attached to the auxiliary machinery chamber of the water jet propulsion watercraft according to the first preferred embodiment of the present invention.

FIG. 5 is a rear view of a state where the coupling 81, the cover member 64, the rotor unit 65, etc., have been removed and shows an arrangement as viewed in the FWD arrow direction in FIG. 4. A plurality (preferably six in the preferred embodiment, for example) of screw holes 62*d* are formed in the flange portion 62*a* (rear end portion) of the crankshaft 62. The plurality of screw holes 62*d* are formed along a circumference R, centered on the rotational center axis L1 of the crankshaft 62 and arranged to have a predetermined radius, while being mutually spaced apart at predetermined angular intervals (intervals of approximately 60 degrees each). A pin hole 62*e*, enabling insertion of a positioning pin 67 to be described below, is further arranged in the flange portion 62*a* at a predetermined position along the circumference R.

Figure 7:
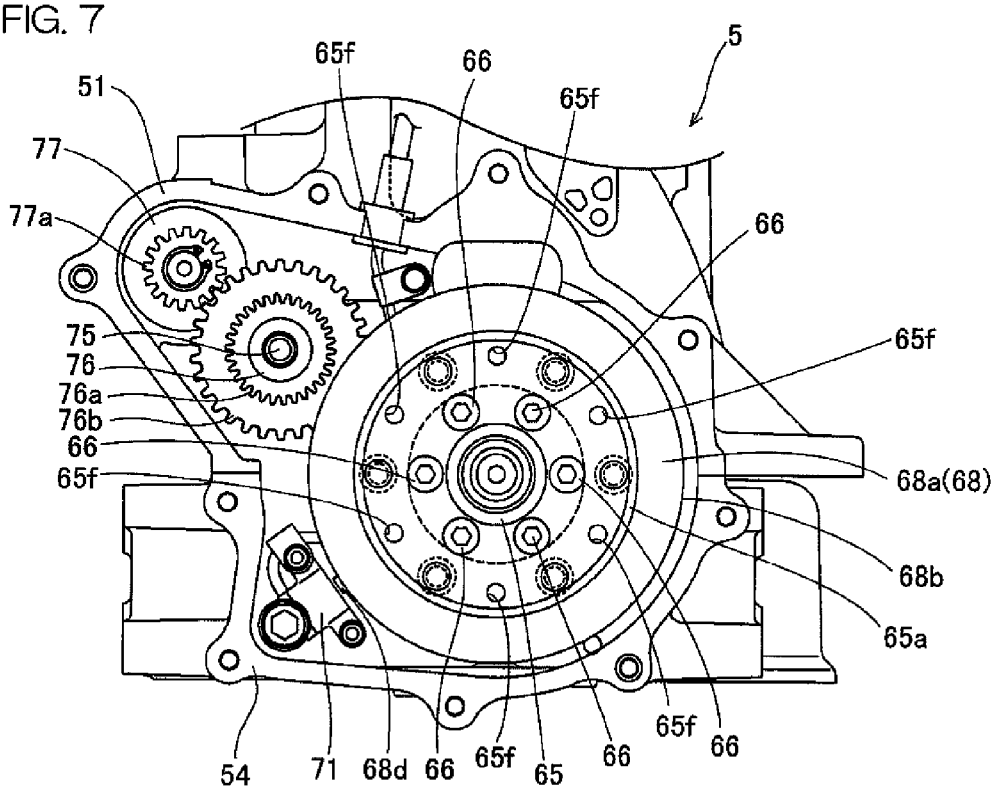
FIG. 7 is a diagram of a state where the rotor unit is attached to the auxiliary machinery chamber of the water jet propulsion watercraft according to the first preferred embodiment of the present invention.

Also, in the first preferred embodiment, as shown in FIG. 4, the output shaft 65 is connected to the flange portion 62*a* at the rear end portion of the crankshaft 62. The output shaft 65 is arranged to be rotatable together with the crankshaft 62 about the rotational center axis L1 of the crankshaft 62. Specifically, the flange portion 65*a* preferably is integral with a front side (FWD arrow direction side) portion of the output shaft 65. A plurality (preferably six in the preferred embodiment, for example) of screw insertion holes 65*b* are formed in the flange portion 65*a* at positions corresponding to the plurality (e.g., six) of screw holes 62*d* of the crankshaft 62. Specifically, the six screw insertion holes 65*b* are formed at equiangular intervals of approximately 60 degrees each. A front end of the flange portion 65*a* is arranged to be capable of being brought into plane contact (contactable) with the flange portion 62*a* (rear end portion) of the crankshaft 62. And as shown in FIG. 4 and FIG. 7, to be described below, screw members 66 arranged to fasten the crankshaft 62 and the output shaft 65 are inserted into the screw insertion holes 65*b* from the rear side of the engine 5. The screw members 66 pass through the screw insertion holes 65*b* and are threadedly fixed in the screw holes 62*d* of the crankshaft 62. The flange portion 62*a* of the crankshaft 62 and the flange portion 65*a* of the output shaft 65 are thereby fastened together. Screw members 66 of the same number (e.g., six) as the number of screw holes 62*d* are used. Each screw member 66 is inserted through the corresponding screw insertion hole 65 and screw hole 62*d*. A fastening axis (center axis L2) of a male screw of each screw member 66 is disposed parallel or substantially parallel to the rotational center axis L1 of the crankshaft 62 and differs from the rotational center axis L1. As shown in FIG. 4, the output shaft 65 is fastened by each screw member 66 along the fastening axis L2 to the rear end portion of the crankshaft 62 at a portion other than the rotational center axis L1 of the flange portion 65*a*.

Also, the screw member 66 is an example of a "fastening member" according to a preferred embodiment of the present invention. The fastening axis L2 of the screw member 66 is the center axis of a screw shaft of the screw member 66 and is a straight line extending along the fastening direction (a direction parallel or substantially parallel to the output shaft 65). By being arranged to be inserted through both of the flange portions 62*a* and 65*a*, the screw shaft opposes both the screw hole 62*d* and the screw insertion hole 65*b* in a circumferential direction of the crankshaft 62 and receives a shear force due to relative rotation of the crankshaft 62 and the output shaft 65. The flange portion 65*a* is an example of a "flange portion of the output shaft," a "front end of the output shaft," and a "second connection portion of the output shaft" according to a preferred embodiment of the present invention.

The protruding portion 65*c* is provided on the flange portion 65*a* of the output shaft 65 (FWD arrow direction side portion of the output shaft 65) along the rotational center axis L1. The protruding portion 65*c* is arranged to be insertable in the recessed portion 62*c* of the crankshaft 62 as described above.

Figure 6:
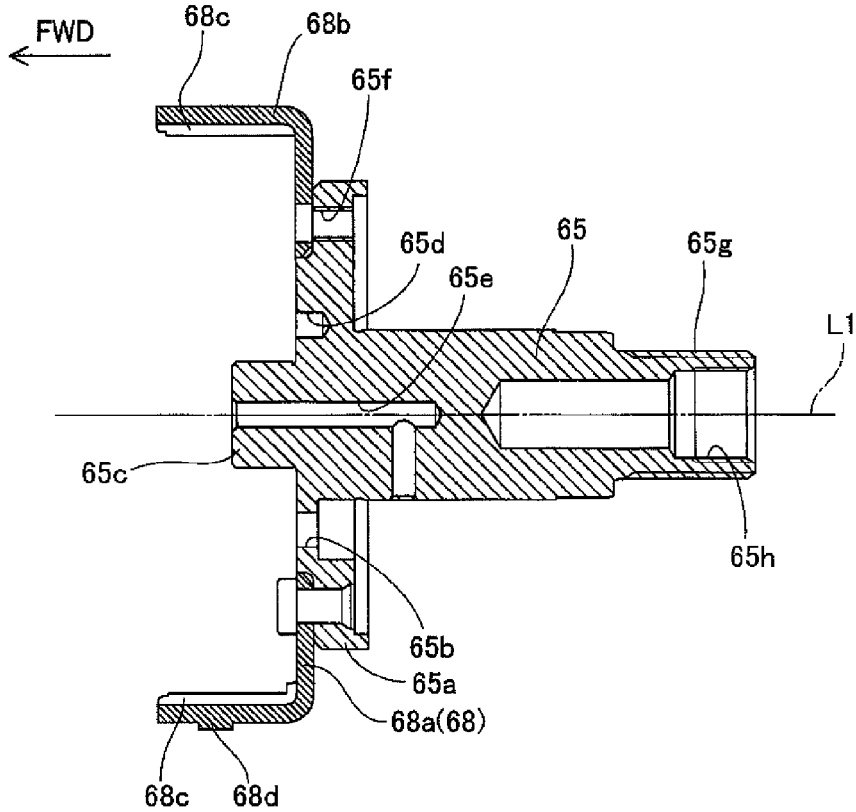
FIG. 6 is a sectional view for describing a structure of an output shaft and a rotor unit of the water jet propulsion watercraft according to the first preferred embodiment of the present invention.

FIG. 6 is a sectional view of a structure of the rotor unit 65. In an FWD arrow direction side surface (front surface) of the flange member 65*a* of the output shaft 65, a pin hole 65*d* is formed at a position separated by a predetermined distance from the rotational center axis L1. Then, as shown in FIG. 4, a positioning pin 67 is inserted into the pin hole 62*e* of the crankshaft 62 and the pin hole 65*d* of the output shaft 65. The pin holes 62*e* and 65*d* and the positioning pin 67 are an example of a "positioning structure" according to a preferred embodiment of the present invention. By the positioning pin 67, a position of the output shaft 65 with respect to the crankshaft 62 in a direction of rotation about the rotational center axis L1 can be set. That is, relative rotation about the rotational center axis L1 of the flange portion 65*a* of the output shaft 65 with respect to the flange portion 62*a* of the crankshaft 62 is thus restricted.

An oil passage portion 65*e* is formed along the rotational center axis L1 of the output shaft 65. The oil passage portion 65*e* is an example of a "second oil passage portion" according to a preferred embodiment of the present invention. The oil passage portion 65*e* is arranged so as to extend rearward from an FWD arrow direction side end portion of the protruding portion 65*c* and be connected to an outer peripheral surface of the output shaft 65 at a portion at which a one-way clutch 72, to be described below is disposed. A space inside the oil passage portion 65*e* and a space inside the oil passage 62*b* are in communication. Oil from the main engine body side is thereby made to flow into the oil passage portion 65*e* via the oil passage portion 62*b* of the crankshaft 62. The oil passage portion 65*e* has a function of supplying the oil, flowing in from the oil passage portion 62*b*, to the one-way clutch 72 to be described below. Oil can thus be supplied readily to the one-way clutch 72.

Also, the flange portion 65*a* of the output shaft 65 is formed to have a larger diameter than the flange portion 62*a* of the crankshaft 62. The rotor unit 68 is fastened preferably by riveting to the FWD arrow direction side surface (front surface) of the flange portion 65*a* of the output shaft 65.

As shown in FIG. 4 and FIG. 6, the rotor unit 68 includes a circumferential attachment portion 68*a*, which spreads in the same manner as the flange portion 65*a*, and a peripheral wall portion 68*b*. The peripheral wall portion 68*b* extends toward the crankcase 54 side (FWD arrow direction side) of the engine 5 from an outer peripheral portion of the attachment portion 68*a*. As shown in FIG. 4, the peripheral wall portion 68*b* of the rotor unit 68 is disposed so as to cover the flange portion 62*a* of the crankshaft 62 and an outer peripheral portion of the stator unit 69. The stator unit 69 is disposed so as to overlap with the flange portion 62*a* when viewed from a direction perpendicular or substantially perpendicular to a direction of extension of the crankshaft 62 (FWD arrow direction). More specifically, a rear portion of the stator unit 69 and a front portion of the flange portion 62*a* are overlapped when viewed from a direction orthogonal to a direction of extension of the crankshaft 62 (FWD arrow direction). The rotor unit 68 serves as a flywheel that stabilizes the rotation of the crankshaft 62 by being arranged to rotate together with the crankshaft 62. Also, a plurality of magnets 68*c* are attached to an inner peripheral surface side of the peripheral wall portion 68*b* of the rotor unit 68.

As shown in FIG. 4, the stator unit 69 is disposed in the interior of the auxiliary machinery chamber 63. The stator unit 69 is positioned so as to surround an outer peripheral portion of the crankshaft 62. The stator unit 69 is an example of an "auxiliary machinery" according to a preferred embodiment of the present invention.

As shown in FIG. 4 and FIG. 5, the stator unit 69 is fixed by being arranged to be screw-fixed to the cylinder body 51 and the crankcase 54 by screw members 70. The stator unit 69 is provided with a plurality of electromagnetic coils 69*a* in correspondence to the plurality of magnets 68*c* (see FIG. 4) of the rotor unit 68 (see FIG. 4). The rotor unit 68 and the stator unit 69 are thus disposed so as to oppose each other circumferentially. Thus, with the rotation of the rotor unit 68 together with the crankshaft 62, an electric current is generated in the electromagnetic coils 69*a*. That is, the rotor unit 68 functions as a flywheel magnet and makes up a power generator together with the stator unit 69. The power generator is thus housed as an example of an auxiliary machinery in the auxiliary machinery chamber 63.

FIG. 7 is a diagram of a state where the rotor unit 68 is attached to the auxiliary machinery chamber 63. A crank angle sensor 71 is disposed at a side of the rotor unit 68. The crank angle sensor 71 is an example of an "auxiliary machinery." As shown in FIG. 4 and FIG. 7, a protrusion 68*d* is provided at an outer peripheral surface side of the peripheral wall portion 68*b* of the rotor unit 68. The protrusion 68*d* is formed at a position corresponding to the crank angle sensor 71. The crank angle sensor 71 has a function of detecting the protrusion 68*d*. Specifically, the output shaft 65 and the rotor unit 68 are rotated with the rotation of the crankshaft 62. The crank angle sensor 71 is arranged to detect the protrusion 68*d* when the protrusion 68*d* approaches the crank angle sensor 71 in this process. That is, the crank angle sensor 71 is arranged to detect the protrusion 68*d* and output a detection signal each time the crankshaft 62 rotates by one turn.

In the first preferred embodiment, the one-way clutch 72 is attached to the flange portion 65*a* of the output shaft 65 as shown in FIG. 4. Specifically, the one-way clutch 72 is attached to a rear surface (surface at an opposite direction side relative to the main engine body) of the output shaft 65. More specifically, a plurality of screw holes 65*f* are formed in the flange portion 65*a* of the output shaft 65 as shown in FIG. 4 and FIG. 7. The one-way clutch 72 is fastened to the flange portion 65*a* by screw members 73 that are screwed into the screw holes 65*f*. The one-way clutch 72 is an example of an "auxiliary machinery" according to a preferred embodiment of the present invention.

Figure 8:
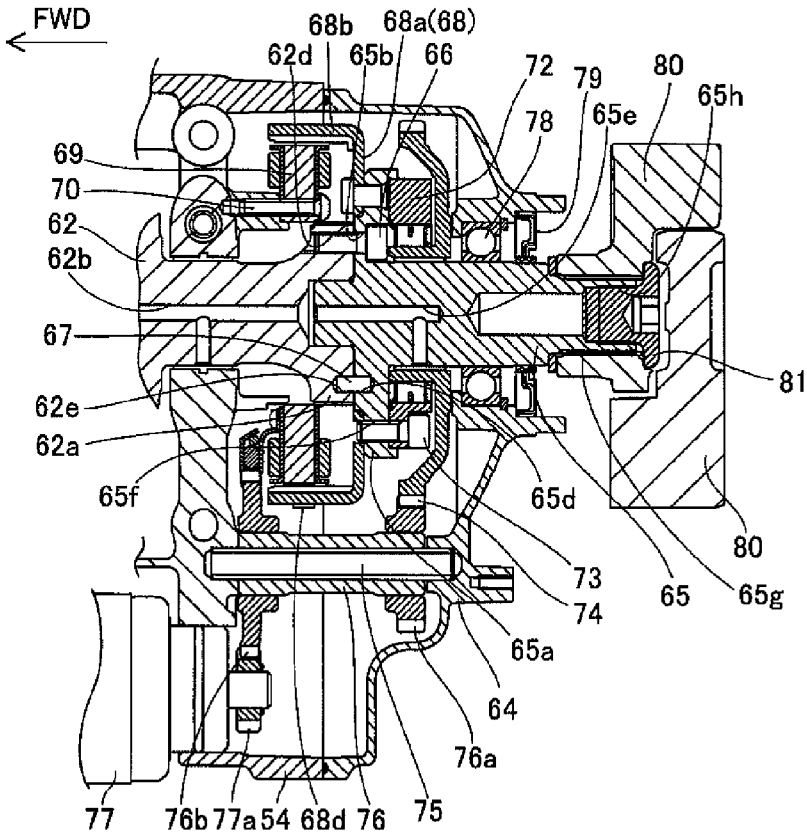
FIG. 8 is a sectional view for describing an arrangement of the auxiliary machinery chamber and a vicinity of a starter motor of the water jet propulsion watercraft according to the first preferred embodiment of the present invention.

FIG. 8 is a sectional view for describing an arrangement related to starting of the engine 5. A gear 74 is attached to the one-way clutch 72. The gear 74 transmits a driving force of a starter motor 77 (self-starting motor) to the output shaft 65. The one-way clutch 72 is disposed between the output shaft 65 and the gear 74. Then, during driving of the engine 5, the one-way clutch 72 transmits the rotation of the gear 74, which is driven by the starter motor 77, to the crankshaft 62 via the flange portion 65*a*. On the other hand, while the engine 5 is running, the one-way clutch 72 makes the gear 74 run idle with respect to the output shaft 65 so that the driving force of the output shaft 65 is not transmitted to the gear 74. The gear 74 is one type of "auxiliary machinery" and is an example of a "second gear" according to a preferred embodiment of the present invention. The gear 74 is rotatably supported on the output shaft 65 at the rear of the flange portion 62*a*.

As shown in FIG. 7 and FIG. 8, a support shaft 75, arranged to extend in parallel or substantially in parallel to the output shaft 65, is disposed at a left side of the output shaft 65. As shown in FIG. 8, the support shaft 75 is fixed by being arranged to be sandwiched by the crankcase 54 and the cover member 64. The support shaft 75 has a gear member 76 disposed rotatably with respect to the support shaft 75. The gear member 76 includes gears 76*a* and 76*b*. The gears 76*a* and 76*b* are arranged to rotate together. The gear 76*a* is constantly engaged with the gear 74 and the gear 74 is arranged to rotate with the rotation of the gear 76*a*.

Also, the gear 76*b* is constantly engaged with a gear 77*a* of the starter motor 77. The starter motor 77 is arranged to be driven when the engine 5 is started, and the gear 77*a* is provided to output the driving force of the starter motor 77 to the output shaft 65 and the crankshaft 62 via the gear member 76 and the gear 74. The gear 77*a* is an example of a "first gear" according to a preferred embodiment of the present invention.

In the first preferred embodiment, the gear 77*a* of the starter motor 77 and the gear 76*b* of the gear member 76 are arranged to be in constant engagement. The gear 76*a* of the gear member 76 and the gear 74 are arranged to be in constant engagement. The gear 77*a* of the starter motor 77 and the gear 74 on the crankshaft 62 are thus coupled in a manner enabling constant transmission of power. On the other hand, by the action of the one-way clutch 72, the driving force of the output shaft 65 is not transmitted to the gear 74 while the engine 5 is running. That is, the gear 74 runs idle with respect to the output shaft 65. Thus, practically, the starter motor 77 is not a load while the engine 5 is running.

Also, a bearing 78 is disposed at the rear of the gear 74 of the output shaft 65. The bearing 78 is attached to the cover member 64, and rotatably supports the output shaft 65 that protrudes rearward from the auxiliary machinery chamber 63. The bearing 78 is an example of a "rotor unit" according to a preferred embodiment of the present invention. A seal member 79 is disposed at the rear of the bearing 78. The seal member 79 seals a portion between the output shaft 65 and the cover member 64 and prevents entry of water, etc., into the interior of the auxiliary machinery chamber 63.

As shown in FIG. 2, the coupling 80 is attached to the rear end portion of the output shaft 65. The coupling 80 is arranged as a pair of a portion at the output shaft 65 side and a portion at the drive shaft 82 side. By mutual engagement of these pair of portions, the drive shaft 82 can be connected to the output shaft 65. As shown in FIG. 4, a screw portion 65*g* is formed on an outer peripheral surface of a rear portion of the output shaft 65. A screw hole 65*h* is formed along the rotational center axis L1 at the rear end portion of the output shaft 65. The coupling 80 is screwed to the screw portion 65*g* of the outer peripheral surface of the output shaft 65. The coupling 80 is arranged to be fastened to the output shaft 65 by being rotated in a predetermined first direction with respect to the screw portion 65*g*.

The coupling 80 is tightened to the output shaft 65 by a retaining plug 81 so as not to fall off from the output shaft 65. The retaining plug 81 is screwed into the screw hole 65*h* while supporting a rear end portion of an axial portion of the output shaft 65 side part of the coupling 80 in the FWD arrow direction. The retaining plug 81 is arranged to become fastened to the output shaft 65 by being rotated in a second direction, which is opposite the first direction, with respect to the screw hole 65*h*. That is, the retaining plug 81 is arranged to become fastened to the output shaft 65 when the coupling 80 is rotated in the direction opposite the direction of being fastened to the screw portion 65*g* of the output shaft 65. A force that tightens the retaining plug 81 to the output shaft 65 is thereby applied when a force, in the rotational direction in which the coupling 80 falls off from the output shaft 65, is applied to the output shaft 65 side portion of the coupling 80. Falling-off of the coupling 80 from the output shaft 65 can thus be prevented.

The crankshaft 62 is rotated in one direction by the engine 5. When the water jet propulsion watercraft 1 is used on water, the impeller 85 receives a load due to water. This load acts to fasten the coupling 80 to the screw portion 65*g* of the output shaft 65. Thus, when the water jet propulsion watercraft 1 is used on water, the coupling 80 and the output shaft 65 are maintained in a firmly coupled state.

On the other hand, for maintenance after use, a user of the water jet propulsion watercraft 1 performs racing of the engine 5 on land. Water inside the hull 2 can thereby be eliminated. Unlike on water, a load due to water is not applied to the impeller 85 during the racing on land. Thus, when the user performs rapid closing of the accelerator from a state where it is open, a rotational speed of the crankshaft 62 decreases sharply. Consequently, a rotational direction force (load) is applied to the drive shaft 82 and the output shaft 65 due to a rotational inertial force of the impeller 85 and the drive shaft 82. In such a case, the retaining plug 81 becomes tightened to the output shaft 65. The falling-off of the coupling 80 from the output shaft 65 can thereby be prevented.

In the first preferred embodiment, the rotational direction load applied to the drive shaft 82 and the output shaft 65 acts about the rotational center axis L1 of the crankshaft 62. On the other hand, the fastening axis L2 of each screw member 66 differs from the rotational center axis L1. Thus, even when the crankshaft 62 receives a load in the first rotational direction or receives a load in the second rotational direction, each of the screw members 66 can receive a shear force due to relative rotation of the flange portion 62*e* of the crankshaft 62 and the flange portion 65*a* of the output shaft 65. According to such screw members 66, changing of fastening forces of the screw members 66 according to the rotational direction load can be prevented. Loosening of the output shaft 65 with respect to the crankshaft 62 can thereby be prevented. Moreover, occurrence of vibration between the crankshaft 62 and the output shaft 65 can be prevented because the crankshaft 62 and the output shaft 65 are fastened by the screw members 66.

An axial portion of each screw member 66 receives the shear force by a reaction force due to contact with the flange portion 62*a* in the direction of relative rotation of the flange portion 62*a* and the flange portion 65*a*, and receives the shear force by a reaction force due to contact with the flange portion 65*a*. The axial portion of each screw member 66 can thus connect the flange portion 62*a* and the flange portion 65*a* by the reaction forces due to contact in the rotational direction in addition to frictional forces. The flange portion 62*a* and the flange portion 65*a* can thus be connected more firmly.

Also, the fastening axis L2 of each screw member 66 that fastens the crankshaft 62 and the output shaft 65 differs from the rotational center axis L1. The rotational direction load can thus be prevented from acting as a force that makes each screw member 66 rotate about its fastening axis L2. Rotation of the screw members 66 in a loosening manner can thereby be prevented, and loosening of the output shaft 65 with respect to the crankshaft 62 can thus be prevented.

The auxiliary machinery chamber 63 is disposed at the rear portion of the main engine body (crankcase 54), and the rotor unit 68 is disposed inside the auxiliary machinery chamber 63. A center of gravity of the water jet propulsion watercraft 1 can thereby be disposed toward the rear. Consequently, a contribution can be made to motion performance (mainly, turning performance) of the water jet propulsion watercraft 1.

In the first preferred embodiment, both the connection of the crankshaft 62 and the output shaft 65 and the connection of the crankshaft 62 and the rotor unit 68 can be achieved in a single step of connecting the output shaft 65, to which the rotor unit 68 is fixed, to the crankshaft 62. For example, in an arrangement where the crankshaft 62 is directly attached to the rotor unit 68, the two steps of a first step of attaching the rotor unit 68 to the crankshaft 62 and a second step of attaching the output shaft 65 to the crankshaft 62 are required and this is troublesome. Moreover, in a process of fixing the rotor unit 68 to the crankshaft 62, the main engine body that houses a large portion of the crankshaft 62 is an obstacle and the process is thus difficult to perform. In contrast, according to the arrangement of the preferred embodiment, the process of fixing the rotor unit 68 to the output shaft 65 can be performed easily because the rotor unit 68 can be fixed in advance to the output shaft 65 before attachment.

As a result of making different the rotational center axis L1 of the crankshaft 62 and the fastening axis L2 of each screw member 66, loosening between the crankshaft 62 and the outputs shaft 65 (loosening of the screw members 66) can be prevented regardless of a magnitude of a rotational inertial force that is transmitted to the crankshaft 62 via the output shaft 65 from the rotor unit 68. The rotor unit 68 may thus be large in weight and the rotor unit 68 can thus be made high in degree of freedom of design.

The rotor unit 68 is a flywheel unit that is fixed to the output shaft 65 and stabilizes the rotation of the crankshaft 62 by being arranged to be rotated together with the crankshaft 62. By thus fixing the output shaft 65, to which the flywheel unit 68 is fixed, to the crankshaft 62, the flywheel unit, which is a heavy object, can be connected readily and in a stable state to the crankshaft 62.

In the first preferred embodiment, the output shaft 65 is provided with the flange portion 65*a* that is contactable with the flange portion 62*a* (rear end portion) of the crankshaft 62 as described above. The output shaft 65 and the crankshaft 62 can thereby be fastened readily in a disposition where the rotational center axis L1 of the crankshaft 62 and the fastening axis L2 of each screw member 66 are differed.

In the first preferred embodiment, the rotor unit 68 is fixed (fastened) to the flange portion 65*a* of the output shaft 65 as described above. The rotor unit 68 can thereby be rotated with the rotation of the output shaft 65. The flange portion 65*a* of the output shaft 65 can be connected to both the flange portion 62*a* of the crankshaft 62 and to the rotor unit 68. The output shaft 65 thus does not have to have a separate flange portion for connection to the crankshaft and a separate flange for connection to the rotor unit, and the output shaft 65 can thus be made short. The rotor unit 68, which is a heavy object, can be readily fixed in a stable state to the output shaft 65 by the flange portion 65*a*.

In the first preferred embodiment, the crankshaft 62 and the output shaft 65 can be fastened readily by fastening the flange portion 62*a* of the crankshaft 62 and the flange portion 65*a* of the output shaft 65 by the screw members 66.

In the first preferred embodiment, the crankshaft 62 can be made short in a fore-and-aft direction because the stator unit 69 and the flange portion 62*a* of the crankshaft 62 are disposed so as to be overlapped when viewed from a direction orthogonal to the rotational center axis L1 as described above. By being arranged to surround the periphery of the stator unit 69 with the rotor unit 68, the rotor unit 68 can be made to oppose the stator unit 69. A power generator that generates electric power by a magnetic interaction of the stator unit 69 and the rotor unit 68 can thereby be arranged.

In the first preferred embodiment, the plurality of screw members 66 are disposed along the circumference R of the predetermined radius, centered on the rotational center axis L1, while arranged to be spaced apart at the predetermined intervals as described above. The output shaft 65 can thereby be fastened firmly with respect to the crankshaft 62 and yet uniformly around the rotational center axis L1. Moreover, the screw members 66, which are inserted through both the crankshaft 62 and the output shaft 65, can restrict relative rotation of the crankshaft 62 and the output shaft 65 because the output shaft 65 is fastened to the crankshaft 62 at positions away from the rotational center axis L1. The rotation of the crankshaft 62 can thereby be transmitted reliably to the output shaft 65. The rotation due to inertia of the rotor unit 68 as the flywheel unit can be transmitted reliably to the crankshaft 62. The rotation of the crankshaft 62 during idling of the engine 5, etc., can thereby be stabilized.

Also, in the first preferred embodiment, the screw holes 62*d* are formed in the flange portion 62*a* of the crankshaft 62, and the screw insertion holes 65*b* are formed in the flange portion 65*a* of the output shaft 65 as described above. The screw members 66 pass through the screw insertion holes 65*b* and are threadedly fixed in the screw holes 62*d* of the crankshaft 62. A work of fastening the output shaft 65 and the crankshaft 62 can thereby be performed from an outer side (rear side) of the main engine body (crankcase 54). The output shaft 65 can thus be fastened firmly and uniformly to the crankshaft 62 by an easily-performed work.

In the first preferred embodiment, the positioning pin 67 is inserted in pin holes 62*e* and 65*d* formed at positions spaced at the predetermined distance from the rotational center axis L1 of the crankshaft 62 as described above. Positioning of the output shaft 65 in the rotational direction with respect to the crankshaft 62 can thereby be performed. By the positioning pin 67, the rotation of the crankshaft 62 can be transmitted more reliably to the output shaft 65. The rotation due to inertia of the rotor unit 68 as the flywheel unit can be transmitted to the crankshaft 62 reliably.

In the first preferred embodiment, the recessed portion 62*c* formed in the rear end portion of the crankshaft 62, and the protruding portion 65*c* formed on the front end portion of the output shaft 65 are fitted together, and the central axes of the recessed portion 62*c* and the protruding portion 65*c* are matched with the rotational center axis L1 as described above. The output shaft 65 and the crankshaft 62 can thereby be disposed coaxially. The protruding portion 65*c* can be fitted in the recessed portion 62*c* before a work of fastening the output shaft 65 and crankshaft 62 by the screw members 66. Circumferential direction positions of the crankshaft 62 and the output shaft 65 can thereby be adjusted in a state where the output shaft 62 and the crankshaft 65 are disposed coaxially. The crankshaft 62 and the output shaft 65 can thereafter be fastened by the screw members 66. A work of assembling together the output shaft 65 and the crankshaft 62 can thereby be performed readily because there is no need to attach the screw members 66 in a state where a worker supports the heavy output shaft 65.

In the first preferred embodiment, the stator unit 69 is attached to the crankcase 54 as described above. Ease of assembly is thereby improved significantly. If an arrangement where the stator unit 69 is supported by the cover member 64 that covers the auxiliary machinery chamber 63 is used, the stator unit 69 must be attached in advance to the cover member 64. An assembly that is thus formed has a large weight as a whole because the stator unit 69 is a heavy object. When this assembly is attached to the crankcase 54, the stator unit 69 is drawn towards the magnets 68*c* of the rotor unit 68. A worker must hold, position, and attach the assembly to the crankcase 54 against both the large gravitational force and the powerful magnetic force that act on the assembly. Moreover, the cover member 64 becomes immersed in water during use of the water jet propulsion watercraft 1 and a portion between the cover member 64 and the crankcase 54 must thus be sealed in a watertight manner. The cover member 64 must thus be positioned accurately with respect to the crankcase 54. Due to such circumstances, installation of the assembly, with which the stator unit 69 is attached to the cover member 64, is a difficult process.

On the other hand, the first preferred embodiment has the structure where the stator unit 69 is supported on the crankcase 54. Thus, the cover member 64, without the stator unit 69 arranged to be attached thereto, can be attached to the crankcase 54. The worker is thus relieved of the difficult task of bearing the large gravitational force and the powerful magnetic force. The workability during attachment of the cover member 64 can thereby improved and more accurate positioning of the cover member 64 is enabled.

In the first preferred embodiment, the output shaft 65 transmits the large driving force from the crankshaft 62 to the drive shaft 82, and a large load is thus applied to portions (the screw members 66) coupling the crankshaft 62 and the output shaft 65. Further, the rotor unit 68, as the flywheel magnet, is coupled to the output shaft 65. Thus, an even larger load in the rotational direction is applied to the screw members 66 that couple together the output shaft 65 and the crankshaft 62. However, even if the output shaft 65 is heavy, the rotor unit 68, which is a heavy object, can be fixed to the output shaft 65 because the loosening of the screw members 66 is prevented. A space between the crankcase 54 and the rotor unit 68 can thereby be secured.

The driving force of the starter motor 77 can be transmitted to the crankshaft 62 via the gear 74 and the output shaft 65. The gear 74 can thereby be positioned at the rear relative to the crankshaft 62. By such disposition of the gear 74, the space between the crankcase 54 and the rotor unit 68 can be secured.

Consequently, the space arranged to dispose the stator unit 69 can be secured between the crankcase 54 and the flange portion 62*a* of the crankshaft 62. The space arranged to dispose the stator unit 69 can thereby be secured between the rear wall of the crankcase 54 and the rotor unit 68. The stator unit 69 can thus be supported on the crankcase 54. A member that can be disposed at the crankcase 54 side (front side) relative to the flange portion 62*a* of the crankshaft 62 is a member that is not fixed to the crankshaft 62, that is, the stator unit 69. This stator unit 69 can be disposed immediately to the rear of the crankcase 54. The disposition space inside the auxiliary machinery chamber 63 can thereby be used efficiently, and the auxiliary machinery chamber 63 can thus be made compact.

By the above, the stator unit 69, the flange portion 62*a* of the crankshaft 62, the rotor unit 68, the flange portion 65*a* of the output shaft 65, the one-way clutch 72, and the gear 74 can be disposed in that order from the front. Although the rotor unit 68 is disposed comparatively rearward, because the stator unit 69 can be disposed in front thereof and the stator unit 69 is covered by the rotor unit 68, there is no worry of the auxiliary machinery chamber 63 becoming large.

In the first preferred embodiment, the plurality of gears, defining the power transmission path from the gear 77*a* of the starter motor 77 to the gear 74 on the output shaft 65, are in the constantly engaged state as described above. Further, the one-way clutch 72 is arranged to cause the gear 74 run idle with respect to the output shaft 65 while the engine 5 is running. The driving force of the stator motor 77 is thus transmitted to the crankshaft 62 via the one-way clutch 72 during the starting of the engine 5. On the other hand, while the engine 5 is running, the power transmission path from the output shaft 65 to the starter motor 77 is interrupted by the one-way clutch 72. By this structure, the need to disengage the engagement of the gear 77*a* with the gears 76*b*, 76*a*, and 74 is eliminated. Damaging of the gears and the starter motor 77 that occurs readily when engagement and disengagement of the gears with each other are repeated can thus be prevented. A highly reliable structure with a low occurrence of malfunction can thus be provided.

Also, in the first preferred embodiment, the one-way clutch 72 is fixed to the rear surface of the flange portion 65*a* of the output shaft 65 as described above. The one-way clutch 72 can thereby be attached firmly and readily to the flange portion 65*a* of the output shaft 65 from the outer side of the main engine body (crankcase 54).

Also, in the first preferred embodiment, the oil passage portion 62*b*, through which the oil flows, is provided in the crankshaft 62 as described above. The output shaft 65 is provided with the oil passage portion 65*e* that is connected to the oil passage portion 62*b* and is arranged to supply the oil to the one-way clutch 72. The oil can thereby be supplied to the one-way clutch 72 with ease. That is, the oil can be supplied to the one-way clutch 72 by supplying the oil to the oil passages 62*b* and 65*e* from the main engine body side.

Second Preferred Embodiment

Figure 9:
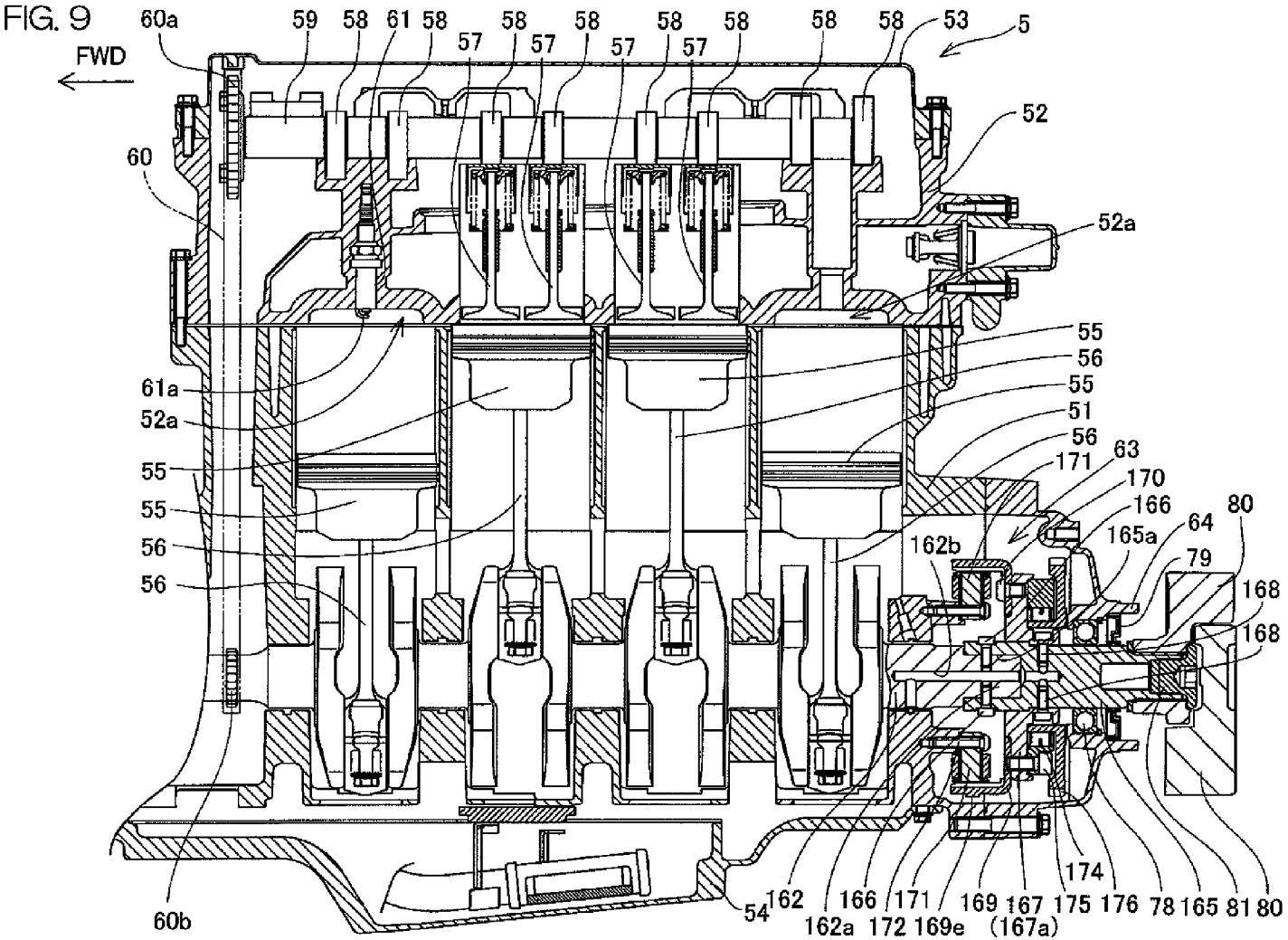
FIG. 9 is a sectional view of an engine of a water jet propulsion watercraft according to a second preferred embodiment of the present invention.
Figure 10:
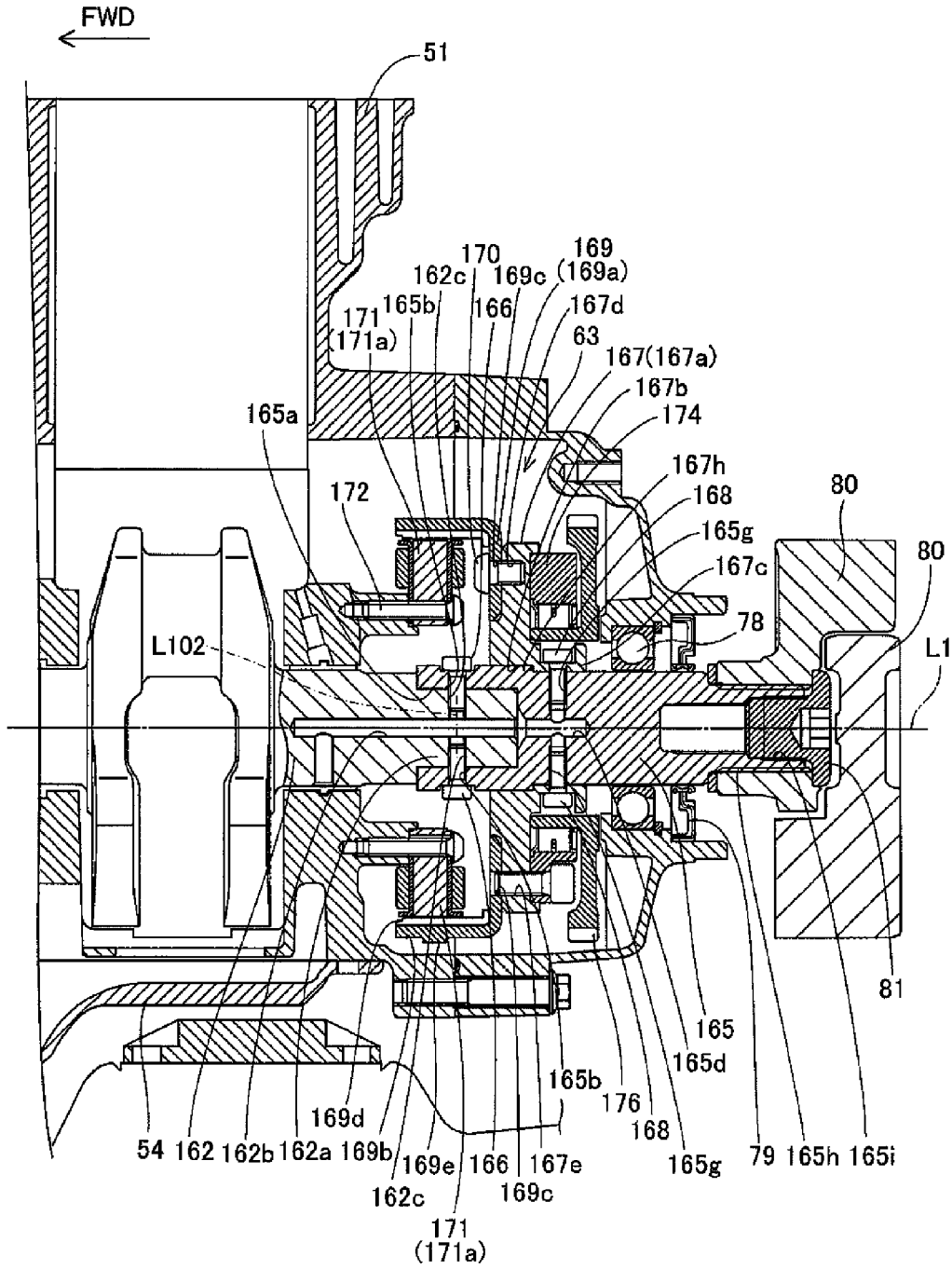
FIG. 10 is a sectional view of a vicinity of an auxiliary machinery chamber of the engine of the water jet propulsion watercraft according to the second preferred embodiment of the present invention.

A structure of a water jet propulsion watercraft according to a second preferred embodiment of the present invention shall now be described. FIG. 9 is a sectional view of an engine of the water jet propulsion watercraft according to the second preferred embodiment of the present invention. FIG. 10 is a sectional view of a vicinity of an auxiliary machinery chamber of the engine. Description of arrangements that are the same as those of the first preferred embodiment shall be omitted.

As shown in FIG. 9 and FIG. 10, a main point of difference of the water jet propulsion watercraft according to the second preferred embodiment with respect to the water jet propulsion watercraft according to the first preferred embodiment is the arrangement by which a crankshaft and an output shaft are fastened together. Specifically, the crankshaft 162 and the output shaft 165 are fastened in a fastening direction that is substantially perpendicular (intersects) the rotational center axis L1 of the crankshaft 162 when viewed from a direction that is perpendicular or substantially perpendicular to the crankshaft 162 (FWD arrow direction).

In the second preferred embodiment, a protruding portion 162*a* that protrudes to the rear is formed on a rear end portion of the crankshaft 162. The protruding portion 162*a* is arranged to have a cylindrical form centered at the rotational center axis L1 of the crankshaft 162 and fits with a recessed portion 165*a* of the output shaft 165. The protruding portion 162*a* is an example of the "first connection portion" according to a preferred embodiment of the present invention. In the crankshaft 162, an oil passage portion 162*b* is formed along the rotational center axis L1 of the crankshaft 162.

Figure 11:
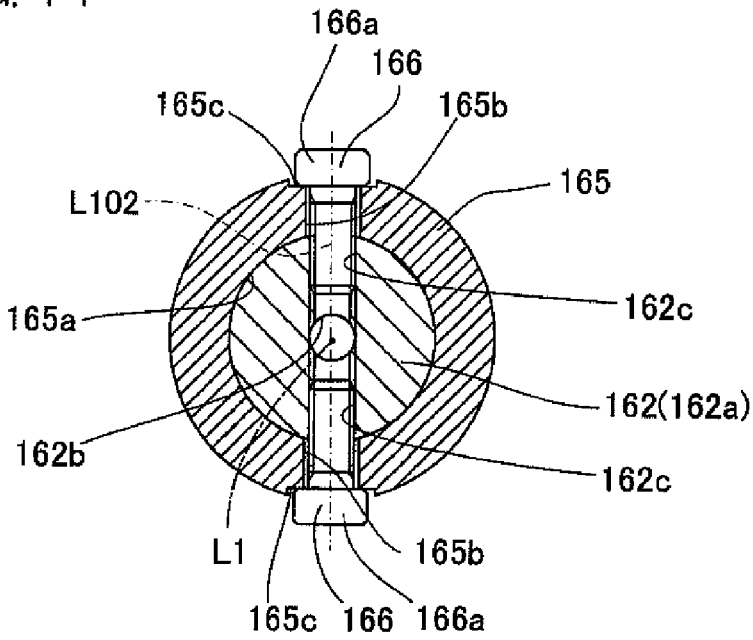
FIG. 11 is a sectional view of a state where a crankshaft and an output shaft of the water jet propulsion watercraft according to the second preferred embodiment are fastened together.

FIG. 11 is a sectional view of a state where the crankshaft 162 and the output shaft 165 are fastened together. As shown in FIG. 10 and FIG. 11, in the second preferred embodiment, screw holes 162*c*, each extending in a direction substantially perpendicular to (intersecting) the rotational center axis L1 of the crankshaft 162, are arranged in an outer peripheral surface of the protruding portion 162*a* of the crankshaft 162. A pair of the screw holes 162*c* are formed spaced apart at an angular interval of approximately 180 degrees about the rotational center axis L1, and a screw portion is formed on an inner surface of each. That is, the pair of screw holes 162*c* respectively extend from the outer peripheral surface of the crankshaft 162 toward the rotational center axis L1, and are disposed symmetrically about the rotational center axis L1. Each of the pair of screw holes 162*c* is connected to the oil passage portion 162*b*. Each of the pair of screw holes 162*c* is arranged to have a length such that tips of screw members 166 do not reach the oil passage portion 162*b*.

Also, as shown in FIG. 10, in the second preferred embodiment, an output shaft 165 is connected to a rear end portion of the crankshaft 162. The output shaft 165 is arranged to be rotatable together with the crankshaft 162 about the rotational center axis L1 of the crankshaft 162. Specifically, the recessed portion 165*a*, which enables insertion of the protruding portion 162*a* of the crankshaft 162, is formed in a front end (FWD arrow direction side end) portion of the output shaft 165. Then, the protruding portion 162*a* of the crankshaft 162 is inserted in the recessed portion 165*a* of the output shaft 165 along the rotational center axis L1. An inner peripheral surface of the recessed portion 165*a* is formed to the same circumferential shape as the cylindrical outer peripheral surface shape of the protruding portion 162*a*. The recessed portion 165*a* is an example of the "second connection portion" according to a preferred embodiment of the present invention. The crankshaft 162 and the output shaft 165 are arranged to be connectable by insertion of the protruding portion 162*a* of the crankshaft 162 in the recessed portion 165*a* of the output shaft 165 along the rotational center axis L1. The protruding portion 162*a* and the recessed portion 165*a* are thereby overlapped when viewed from a direction perpendicular or substantially perpendicular to a direction of extension (FWD arrow direction) of the crankshaft 162.

As shown in FIG. 10 and FIG. 11, in the second preferred embodiment, screw insertion holes 165*b*, each extending in a direction substantially perpendicular to (intersecting) the rotational center axis L1 of the output shaft 165, are formed in an outer peripheral surface of the recessed portion 165*a* in the vicinity of the front end (FWD arrow direction side end) portion of the output shaft 165. A pair of the screw insertion holes 165*b* are spaced apart at an angular interval of approximately 180 degrees about the rotational center axis L1. That is, the pair of screw insertion holes 165*b* respectively extend from the outer peripheral surface of the outer shaft 165 toward the rotational center axis L1. Also, the screw insertion holes 165*b* are disposed symmetrically about the rotational center axis L1. The screw insertion holes 165*b* are an example of a "screw insertion hole" according to a preferred embodiment of the present invention.

When the output shaft 165 is connected to the crankshaft 162, the pair of screw insertion holes 165*b* are respectively disposed at positions corresponding to the pair of screw holes 162*c* of the crankshaft 162. Then, the screw members 166 of a number corresponding to the number of the screw insertion holes 165*b* are provided, and each screw member 166 is threadedly fixed in the corresponding screw hole 162*c* via the corresponding screw insertion hole 165*b*. Each screw member 166 extends toward the rotational center axis L1 of the crankshaft 162. The output shaft 165 is thereby fastened to the crankshaft 162. That is, the protruding portion 162*a* and the recessed portion 165*a*, which overlap when viewed from a direction perpendicular or substantially perpendicular to the crankshaft 162 (FWD arrow direction), are fastened in a fastening direction along a fastening axis L102 that is substantially perpendicular to (intersects) the rotational center axis L1 of the crankshaft 162. The fastening axis L102 of each screw member 166 is substantially perpendicular to (intersects) the rotational center axis L1. The screw members 166 are an example of the "fastening member" according to a preferred embodiment of the present invention. The fastening axis L102 of each screw member 166 is a center axis of a screw shaft of the screw member 166 and is a straight line extending along the fastening direction (a direction parallel or substantially parallel to the output shaft 165). By being arranged to be inserted through both the protruding portion 162*a* and the recessed portion 165*a*, the screw shaft opposes both the screw hole 162*c* and the screw insertion hole 165*b* in a circumferential direction of the crankshaft 162, and receives a shear force due to relative rotation of the crankshaft 162 and the output shaft 165.

As shown in FIG. 11, a pair of planar bearing surface portions 165*c* are formed in the outer peripheral surface of the recessed portion 165*a* of the output shaft 165. The pair of bearing surface portions 165*c* are disposed at equal intervals about the rotational center axis L1. The pair of screw insertion holes 165*b* respectively open to the corresponding bearing surface portions 165*c*. The bearing surface portions 165*c* receive head portions 166*a* of the screw members 166 by plane contact. Each screw member 166 is coupled to the corresponding screw hole 162*c* through the corresponding screw insertion hole 165*b*. Each screw member 166 can thereby be fastened firmly to the corresponding screw hole 162*c*, and the screw member 166 can thus be prevented from falling out of the screw insertion hole 165*b* and the screw hole 162*c*. The tip of each screw member 166 is disposed inside the corresponding screw hole 162*c* and does not reach the oil passage portion 162*b*.

Figure 12:
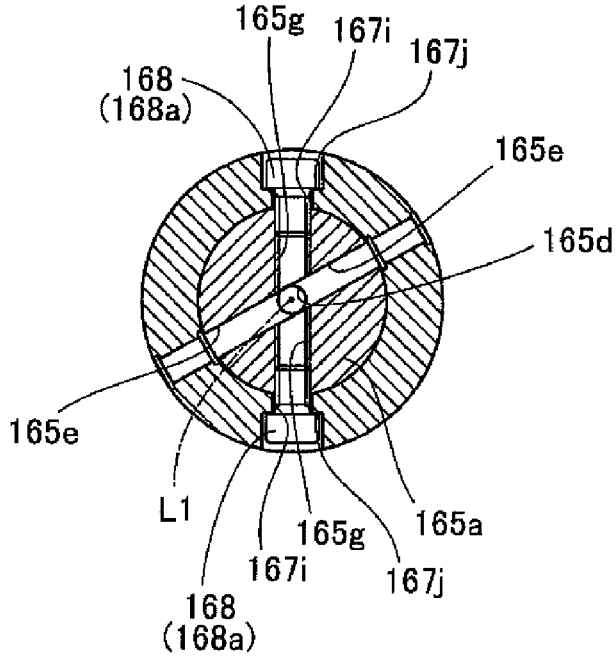
FIG. 12 is a sectional view of a state where the output shaft and a flange member of the water jet propulsion watercraft according to the second preferred embodiment are fastened together.

FIG. 12 is a sectional view of a state where the output shaft 165 and a flange member 167 are fastened together. As shown in FIG. 10 and FIG. 12, an oil passage portion 165*d* is formed along the rotational center axis L1 of the output shaft 165. The oil passage portion 165*d* is arranged to extend rearward from a bottom portion of the recessed portion 165*a* and is connected to the oil passage portion 162*b* of the crankshaft 162. The oil passage portion 165*d* is connected to a branch portions 165*e*, which are perpendicular or substantially perpendicular to the rotational center axis L1 of the output shaft 165. The branch portions 165*e* are formed for supplying oil to a one-way clutch 174 and are disposed at a plurality of locations (two locations) at equal intervals in a circumferential direction of the output shaft 165. The branch portions 165*e* open to the outer peripheral surface of the output shaft 165.

Figure 13:
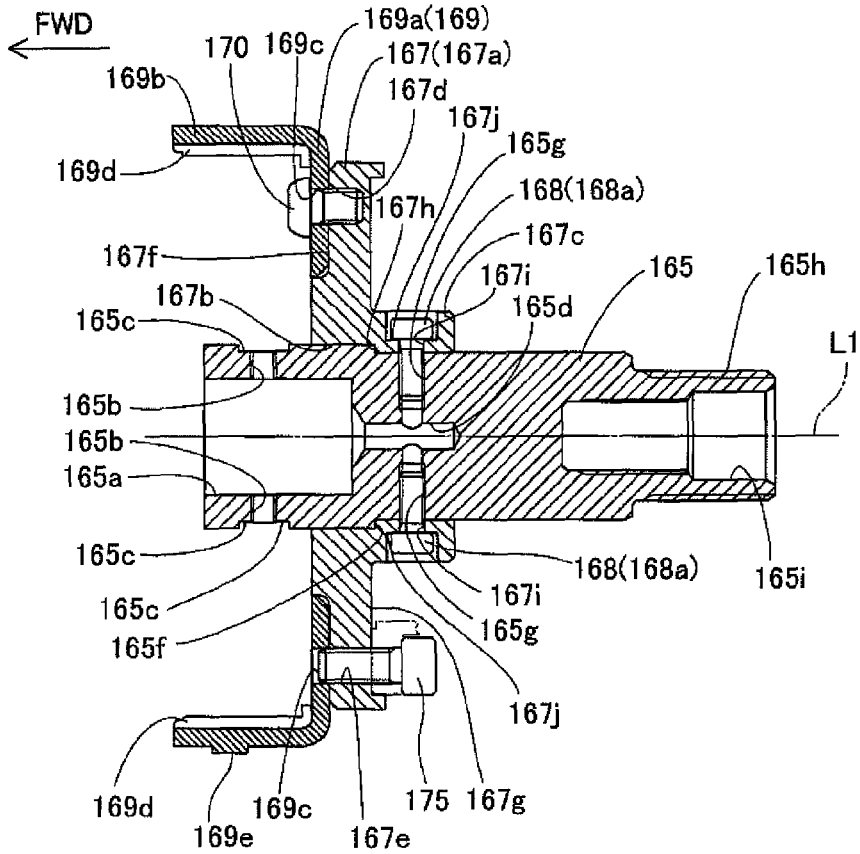
FIG. 13 is a sectional view for describing a structure of the output shaft and a vicinity of the flange member of the water jet propulsion watercraft according to the second preferred embodiment of the present invention.

FIG. 13 is a sectional view for describing a structure of the output shaft 165 and a vicinity of the flange member 167. A rearward-facing step portion 165*f* is formed circumferentially on the outer peripheral surface of the output shaft 165. The flange member 167 is fitted onto the output shaft 165. In fitting the flange member 167 onto the output shaft 165, the step portion 165*f* contacts a step portion 167*h* of the flange member 167 to set the position of the flange member 167 with respect to the output shaft 165.

At the rear of the step portion 165*f* of the outer peripheral surface of the output shaft 165, a pair of screw holes 165*g* are formed spaced apart at an angular interval of approximately 180 degrees. Each screw hole 165*g* extends in a direction substantially perpendicular to (intersecting) the rotational center axis L1 of the output shaft 165. That is, the pair of screw holes 165*g* respectively extend toward the rotational center axis L1 of the output shaft 165 and are disposed symmetrically about the rotational center axis L1 of the output shaft 165. The pair of screw holes 165*g* are connected to the oil passage portion 165*d*. A screw member 168 is coupled to each of the pair of screw holes 165*g*. Each of the pair of screw holes 165*g* is arranged to have a length such that the screw member 168 does not reach the oil passage portion 165*d* when the screw member 168 is coupled.

As shown in FIG. 10 and FIG. 13, in the second preferred embodiment, the flange member 167 is fitted onto an outer peripheral surface portion of the output shaft 165 inside the auxiliary machinery chamber 63. The flange member 167 includes a disk-like flange portion 167*a*, an inner peripheral surface portion 167*b* formed at an inner side of the flange portion 167*a*, and a thin portion 167*c* at the rear of the flange portion 167*a*. A rotor unit 169 is attached to the flange portion 167. A screw hole 167*d* for attaching the rotor unit 169 and screw holes 167*e* for attaching the one-way clutch 174 are arranged so as to extend in the fore-and-aft direction in the flange portion 167*a*. The screw hole 167*d* and the screw holes 167*e* are respectively spaced apart at predetermined intervals along a circumference centered at the rotational center axis L1 of the flange member 167. The rotor unit 169 is an example of an "auxiliary machinery" according to a preferred embodiment of the present invention.

A circumferential step portion 167*f* for disposing the rotor unit 169 is formed at an FWD arrow direction side surface of the flange portion 167*a*. An annular groove portion 167*g* for disposing the one-way clutch 174 is formed in a rear surface of the flange portion 167*a*. A forward facing step portion 167*h* is formed on the inner peripheral surface portion 167*b* of the flange member 167. The step portion 167*h* is brought into contact with the step portion 165*f* of the output shaft 165 by the flange member 167 being fitted onto the output shaft 165 with the inner peripheral surface portion 167*b* being passed along an outer peripheral surface portion of the output shaft 165.

Also, a pair of screw insertion holes 167*i* are spaced apart at an angular interval of approximately 180 degrees on an outer peripheral surface of the thin portion 167*c*. Each of the pair of screw insertion holes 167*i* extends in a direction substantially perpendicular to (intersecting) the rotational center axis L1 of the flange member 167 (output shaft 165). That is, the pair of screw insertion holes 167*i* respectively extend toward the rotational center axis L1 of the flange member 167 (output shaft 165). The pair of screw insertion holes 167*i* are arranged to be respectively disposed at positions corresponding to the pair of screw holes 165*g* of the output shaft 165 when the flange member 167 is fitted onto the output shaft 165. The flange member 167 is fastened to the output shaft 165 by each screw member 168 arranged to be threadedly fixed in the corresponding screw hole 165*g* via the corresponding screw insertion hole 167*i*. The flange member 167 and the output shaft 165 thus can be said to be fastened in a fastening direction substantially perpendicular to (intersecting) the rotational center axis L1. The flange member 167 and the output shaft 165 are fastened along the direction directed toward the rotational center axis L1 from the outer peripheral surface portion of the output shaft 165. The screw members 168 are an example of a "flange fastening member" according to a preferred embodiment of the present invention.

Also, a pair of planar bearing surface portions 167*j* are formed in the outer peripheral surface of the thin portion 167*c* of the flange member 167. The pair of bearing surface portions 167*j* are disposed at equal intervals about the rotational center axis L1. The pair of screw insertion holes 167*i* respectively open to the corresponding bearing surface portions 167*j*. The bearing surface portions 167*j* receive head portions 168*a* of the screw members 168 by plane contact. Each screw member 168 is coupled to the corresponding screw hole 165*g* through the corresponding screw insertion hole 167*i*. Each screw member 168 can thereby be fastened firmly to the corresponding screw hole 165*g* through the corresponding screw insertion hole 167*i*. The screw member 168 can thus be prevented from falling out of the screw insertion hole 167*i* and the screw hole 165*g*.

In the second preferred embodiment, the rotor unit 169 is attached to the FWD arrow direction side surface of the flange member 167. As shown in FIG. 10 and FIG. 13, the rotor unit 169 includes a disk-like attachment portion 169*a* and a cylindrical peripheral wall portion 169*b*. The attachment portion 169*a* opposes the flange portion 167*a* of the flange member 167. The peripheral wall portion 169*b* extends from one end of an outer peripheral portion of the attachment portion 169*a* to a crankcase 54 side (FWD arrow direction side) of the engine 5. As shown in FIG. 13, a screw insertion hole 169*c* is formed in the attachment portion 169*a* of the rotor unit 169. A screw member 170 is screwed into the screw hole 167*d* of the flange member 167 via the screw insertion hole 169*c*. The attachment portion 169*a* is thereby attached to the step portion 167*f* of the flange member 167. As shown in FIG. 10, the peripheral wall portion 169*b* of the rotor unit 169 is disposed so as to extend toward the crankcase 54 side and cover an outer peripheral portion of a stator unit 171. By being arranged to rotate together with the crankshaft 162, the rotor unit 169 serves as a flywheel that stabilizes the rotation of the crankshaft 162. A plurality of magnets 169*d* are attached to an inner peripheral surface side of the peripheral wall portion 169*b* of the rotor unit 169.

The stator unit 171, which surrounds an outer peripheral portion of the crankshaft 162, is disposed in the interior of the auxiliary machinery chamber 63. The stator unit 171 is disposed so as to overlap with a portion at which the crankshaft 162 and the output shaft 165 are fastened together (the protruding portion 162*a* and the recessed portion 165*a*) when viewed from a direction perpendicular or substantially perpendicular to the crankshaft 162.

Figure 14:
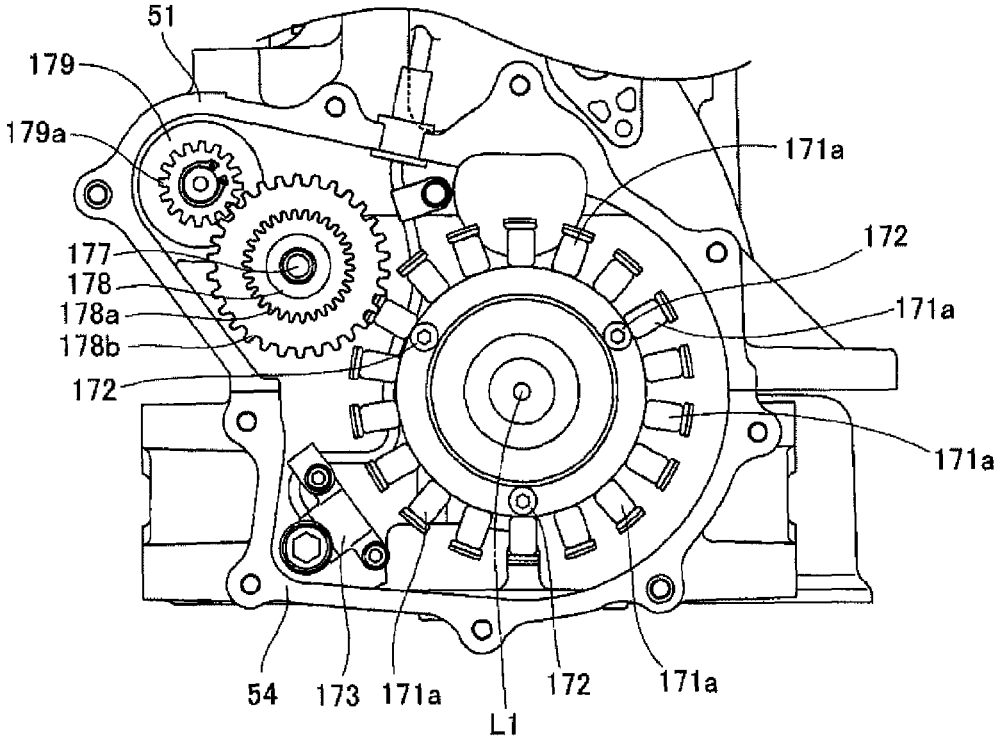
FIG. 14 is a diagram for describing an arrangement of a stator unit and a crank angle sensor of the water jet propulsion watercraft according to the second preferred embodiment of the present invention.

FIG. 14 is a diagram for describing an arrangement of the stator unit and a crank angle sensor. As shown in FIG. 10 and FIG. 14, the stator unit 171 is fixed by being screwed or fixed to the cylinder body 51 and the crankcase 54 by screw members 172. Also, the stator unit 171 is provided with a plurality of electromagnetic coils 171*a* in correspondence to the plurality of magnets 169*d* of the rotor unit 169 (see FIG. 10). The rotor unit 169 and the stator unit 171 are thus disposed so as to oppose each other circumferentially. Thus, with the rotation of the rotor unit 169 together with the crankshaft 162, an electric current is generated in the electromagnetic coils 171*a*. That is, the rotor unit 169 functions as a flywheel magnet and defines a power generator together with the stator unit 171. The power generator is thus housed as an example of an auxiliary machinery in the auxiliary machinery chamber 63.

As shown in FIG. 14, a crank angle sensor 173 is disposed at a left side of the rotor unit 169. The crank angle sensor 173 is an example of an "auxiliary machinery" according to a preferred embodiment of the present invention. As shown in FIG. 10 and FIG. 14, a protrusion 169*e* is provided at an outer peripheral surface side of the peripheral wall portion 169*b* of the rotor unit 169. The protrusion 169*e* is formed at a position corresponding to the crank angle sensor 173. The crank angle sensor 173 has a function of detecting the protrusion 169*e*. Specifically, the rotor unit 169 is rotated with the rotation of the crankshaft 162. The crank angle sensor 173 is arranged to detect the protrusion 169*e* when the protrusion 169*e* approaches the crank angle sensor 173 in this process. That is, the crank angle sensor 173 is arranged to detect the protrusion 169*e* and output a detection signal each time the crankshaft 162 rotates by one turn.

Also, in the second preferred embodiment, the one-way clutch 174 is attached to the flange portion 167*a* of the flange member 167 as shown in FIG. 10 and FIG. 13. Specifically, the one-way clutch 174 is attached to a rear surface of the output shaft 165. More specifically, a plurality of screw holes 167*e* are formed in the flange portion 167*a* of the flange member 167. The one-way clutch 174 is an example of an "auxiliary machinery" according to a preferred embodiment of the present invention. Also, the one-way clutch 174 is fitted in the groove portion 167*g* formed in the rear surface of the flange member 167. Then, screw members 175 are passed through screw insertion holes of the one-way clutch 174 from a side in the opposite direction of the FWD arrow direction (rear side) and threadedly fixed in the screw holes 167*e* of the flange member 167. The one-way clutch 174 is thereby fastened to the flange portion 167*a*. The screw members 175 pass through the screw insertion holes 169*c* of the rotor unit 169.

Figure 15:
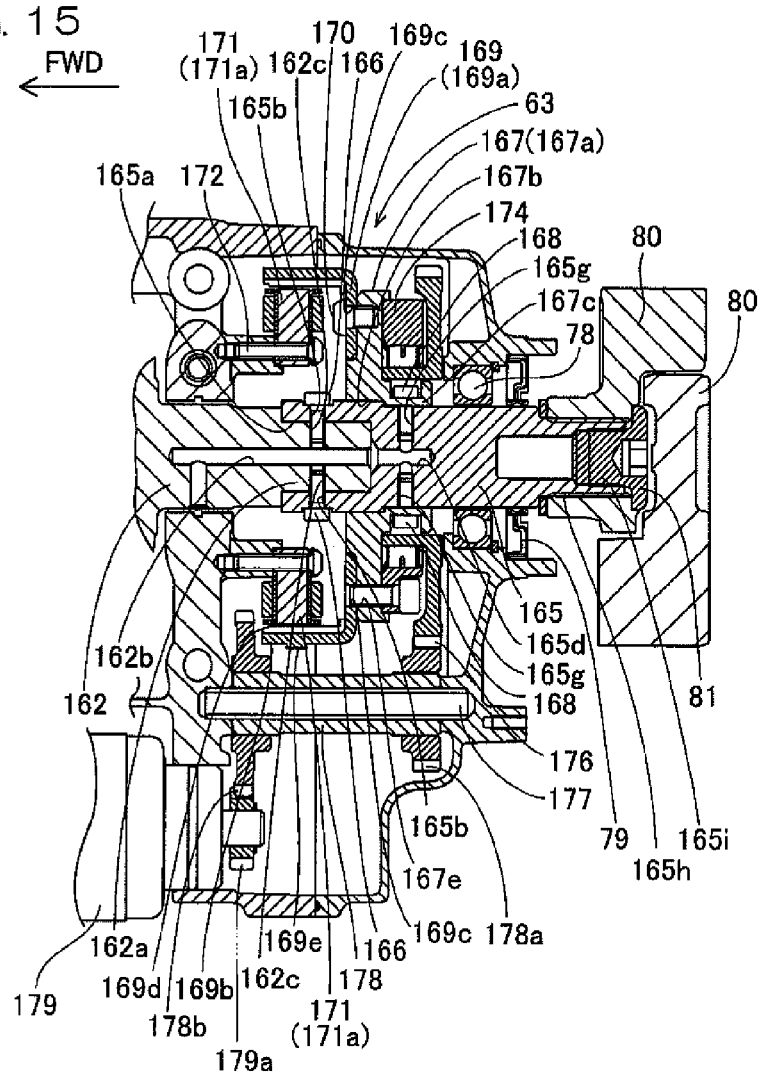
FIG. 15 is sectional view for describing an arrangement of a starter motor and a vicinity of a support shaft of the water jet propulsion watercraft according to the second preferred embodiment of the present invention.

FIG. 15 is sectional view for describing an arrangement of a starter motor 179 and a vicinity of a support shaft 177. A gear 176 is attached to the one-way clutch 174. The gear 176 transmits a driving force of the starter motor 179 to the output shaft 165 via the flange member 167. The one-way clutch 174 is disposed between the flange member 167 and the gear 176. Then, during driving of the engine 5, the one-way clutch 174 transmits the rotation of the gear 176, which is driven by the starter motor 179, to the crankshaft 162 via the flange member 167 and the output shaft 165. On the other hand, while the engine 5 is running, the one-way clutch 174 makes the gear 176 run idle with respect to the output shaft 165 so that the driving force of the output shaft 165 is not transmitted to the gear 176 via the flange member 167. The gear 176 is one type of "auxiliary machinery" and is an example of the "second gear" according to a preferred embodiment of the present invention. The gear 176 is rotatably supported on the output shaft 165 at the rear of the flange member 167.

As shown in FIG. 14 and FIG. 15, the support shaft 177, extending in parallel or substantially in parallel to the output shaft 165, is disposed at a left side of the output shaft 165. As shown in FIG. 15, the support shaft 177 is fixed by being arranged to be sandwiched by the crankcase 54 and the cover member 64. A gear member 178 is disposed rotatably with respect to the support shaft 177. The gear member 178 includes gears 178*a* and 178*b*. The gears 178*a* and 178*b* are arranged to rotate integrally. The gear 178*a* is constantly engaged with the gear 176 and the gear 176 is arranged to rotate with the rotation of the gear 178*a*.

The gear 178*b* is constantly engaged with a gear 179*a* of the starter motor 179. The starter motor 179 is arranged to be driven when the engine 5 is started, and the gear 179*a* is provided to output the driving force of the starter motor 179 to the output shaft 165 and the crankshaft 162 via the gear member 178, the gear 176, and the flange member 167. The gear 179*a* is an example of the "first gear" according to a preferred embodiment of the present invention.

In the second preferred embodiment, the gear 179*a* of the starter motor 179 and the gear 178*b* of the gear member 178 are arranged to be in constant engagement. The gear 178*a* of the gear member 178 and the gear 176 are arranged to be in constant engagement. The gear 179*a* of the starter motor 179 and the gear 176 on the output shaft 165 are thus coupled in a manner enabling constant transmission of power. On the other hand, by the action of the one-way clutch 174, the driving force of the output shaft 165 is not transmitted to the gear 176 while the engine 5 is running. That is, the gear 176 runs idle with respect to the output shaft 165. Thus, practically, the starter motor 179 is not a load while the engine 5 is running.

In the second preferred embodiment, the crankshaft 162 and the output shaft 165 are fastened by the screw members 166 in the fastening directions perpendicular or substantially perpendicular to (intersecting) the rotational center axis L1 of the crankshaft 162 as described above. That is, the fastening axis L102 of each screw member 166 extends in the fastening direction that intersects the rotational center axis L1 and differs from the rotational center axis L1. By this arrangement, the loosening of the output shaft 165 with respect to the crankshaft 162 can be prevented during racing on land because a load that rotates each screw member 166 so as to loosen the screw member 166 is prevented from acting on the screw member 166.

The output shaft 165 and the crankshaft 162 are fastened in directions perpendicular or substantially perpendicular to the rotational center axis L1. The screw members 166 can thereby be used as retaining members that prevent the output shaft 165 and the crankshaft 162 from moving in directions of separating along the rotational center axis L1.

By the auxiliary machinery chamber 63 is disposed at the rear portion of the main engine body (crankcase 54), the center of gravity of the engine 5 can be disposed at the rear because comparatively heavy objects, such as the power generating apparatus, made up of the rotor unit 169 and the stator unit 171, housed in the auxiliary machinery chamber 63, can be disposed at the rear of the engine 5. The center of gravity of the water jet propulsion watercraft can thereby be disposed at the rear. Consequently, a contribution can be made to motion performance (mainly, turning performance) of the water jet propulsion watercraft.

In the second preferred embodiment, the portions of the protruding portion 162*a* of the crankshaft 162 and the recessed portion 165*a* of the output shaft 165 that overlap when viewed from a direction perpendicular or substantially perpendicular to the crankshaft 162 are fastened together by the screw members 166 as described above. The crankshaft 162 and the output shaft 165 can thus be fastened readily in the fastening directions that intersect (are orthogonal to) the rotational center axis L1 by the screw members 166.

In the second preferred embodiment, each screw member 166 can be inserted toward the rotational center axis L1 into the screw hole 162*c* of the protruding portion 162*a* of the crankshaft 162 and the screw insertion hole 165*b* of the recessed portion 165*a* of the output shaft 165 as described above. The crankshaft 162 and the output shaft 165 can thereby be fastened readily in the directions that are perpendicular or substantially perpendicular to the rotational center axis L1.

Also, in the second preferred embodiment, the plurality of screw members 166 are disposed mutually symmetrically (across a 180 degrees angle interval) with respect to the rotational center axis L1 of the crankshaft 162 as described above. Biasing of the load applied to the crankshaft 162 and the output shaft 165 can thereby be prevented. Consequently, the crankshaft 162 and the output shaft 165 can be fastened together firmly.

Also, in the second preferred embodiment, the tips of the screw members 166 are arranged so as not to reach the oil passage portion 162*b* as described above. Clogging of the oil passage portion 162*b* by the screw members 166 can thereby be prevented. Reduction of a flow amount of the oil in the oil passage portion 162*b* can thus be prevented.

The protruding portion 162*a* and the recessed portion 165*a* can be fitted so as to overlap as viewed from the direction orthogonal to the crankshaft 162, and the overlapping portions can be fastened readily by the screw members 166.

By the protruding portion 162*a* and the recessed portion 165*a* being arranged to fit together, the output shaft 165 and the crankshaft 162 can be fitted in a coaxial state at a point prior to fastening the protruding portion 162*a* and the recessed portion 165*a* by the screw members 166. The screw members 166 can thus be attached without having to support the output shaft 165 manually. That is, the screw members 166 do not have to be attached while manually supporting the output shaft 165, to which the heavy rotor unit 169 is fixed, and positioning the output shaft 165 with respect to the crankshaft 162. The work of installing the output shaft 165 onto the crankshaft 162 can thereby be performed readily.

In the second preferred embodiment, each screw member 168 can be inserted toward the rotational center axis L1 into the screw insertion hole 167*i* of the flange member 167 and the screw hole 165*g* of the output shaft 165 as described above. The flange member 167 can thereby be fastened readily to the output shaft 165 in the directions perpendicular or substantially perpendicular to the rotational center axis L1.

Also, in the second preferred embodiment, the tips of the screw members 168 are arranged so as not to reach the oil passage portion 165*d* as described above. Clogging of the oil passage portion 165*d* by the screw members 168 can thereby be prevented. Reduction of the flow amount of the oil in the oil passage portion 165*d* can thus be prevented.

In the second preferred embodiment, as described above, the screw members 168 fasten the flange member 167 and the output shaft 165 together along directions from the outer peripheral surface portions of the output shaft 165 to the rotational center axis L1. The flange member 167 can thereby be fastened readily to the output shaft 165 in the directions perpendicular or substantially perpendicular to the rotational center axis L1 by the screw member 168.

In the second preferred embodiment, the plurality of gears, performing the power transmission from the gear 179*a* of the starter motor 179 to the gear 176 on the output shaft 165, are in the constantly engaged state as described above. Further, the one-way clutch 174 is provided that makes the gear 176 run idle with respect to the flange member 167 while the engine 5 is running. The driving force of the stator motor 179 is thus transmitted to the crankshaft 162 via the one-way clutch 174 during the starting of the engine 5. On the other hand, while the engine 5 is running, the power transmission path from the output shaft 165 to the starter motor 179 is interrupted by the one-way clutch 174. By this structure, the need to disengage the engagement of the gear 179*a* with the gears 178*b*, 178*a*, and 176 is eliminated. Damaging of the gears and the starter motor 179 that occurs readily when engagement and disengagement of the gears with each other are repeated can thus be prevented. A highly reliable structure with a low occurrence of malfunction can thus be provided.

It is to be understood that the preferred embodiments disclosed herein are by all means illustrative and not restrictive. The scope of the present invention is defined by the claims and not by the preceding description of the preferred embodiments, and all changes that fall within the metes and bounds of the claims or equivalence of such meets and bounds are therefore intended to be embraced by the claims.

For example, according to the first and second preferred embodiments, the rotor unit, the stator unit, the one-way clutch, the gears, and the bearings were described as examples of the auxiliary machinery housed in the auxiliary machinery chamber. However, for example, a sprocket for driving a cam shaft and other auxiliary machinery may also be housed in the auxiliary machinery chamber.

Although in the first preferred embodiment, the rotational center axis of the crankshaft and the fastening axes of the screw members are preferably disposed in parallel or substantially in parallel, the present invention is not restricted thereto. The rotational center axis of the crankshaft and the fastening axes of the screw members may instead be disposed in a twisted relationship or an intersecting relationship.

Although in the second preferred embodiment, the rotational center axis of the crankshaft and the fastening axes of the screw members are preferably disposed so as to intersect, the present invention is not restricted thereto. The rotational center axis of the crankshaft and the fastening axes of the screw members may instead be disposed in a twisted relationship.

For example, according to the first preferred embodiment, an example was described where flange portions are provided both at the rear end portion of the first connection portion of the crankshaft and at the second connection portion of the output shaft, and the flange portion of the crankshaft and the flange portion of the output shaft are fastened. However, for example, the rear end portion of the crankshaft and the flange portion of the output shaft may be arranged to be fastened without providing the flange portion at the first connection portion of the crankshaft. Or, the flange portion of the crankshaft and the front end portion of the output shaft may be arranged to be fastened without providing the flange portion at the second connection portion of the output shaft. Or, flange portions do not have to be disposed at either the crankshaft or the output shaft. Even in this case, the fastening axes of the screw members that fasten the rear end portion of the crankshaft and the front end portion of the output shaft are disposed at positions shifted from the rotational center axis of the crankshaft.

Although according to the first preferred embodiment, an example where the flange portion of the crankshaft and the flange portion of the output shaft are preferably fastened by the screw members was described, the present invention is not restricted thereto. For example, the same advantage can be attained by fastening the flange portion of the crankshaft and the flange portion of the output shaft by riveting. The same object can be attained by a structure that fastens the flange portion of the crankshaft and the flange portion of the output shaft by a coupling that clamps the two flange portions. The coupling fastens the flange portion of the crankshaft and the flange portion of the output shaft along a fastening direction parallel to the output shaft.

Although according to the first preferred embodiment, an example where the recessed portion is provided at the rear end portion of the crankshaft and the protruding portion is provided at the front end portion of the output shaft was described, the present invention is not restricted thereto. For example, a protruding portion may be provided at the rear end portion of the crankshaft and a recessed portion may be provided at the front end portion of the output shaft. Although according to the second preferred embodiment, an example where the protruding portion is preferably provided at the rear end portion of the crankshaft and the recessed portion is provided at the front end portion of the output shaft was described, the present invention is not restricted thereto. For example, a recessed portion may be provided at the rear end portion of the crankshaft and a protruding portion may be provided at the front end portion of the output shaft.

In the first preferred embodiment, the screw holes of the flange portion of the crankshaft are preferably formed along the circumference, centered on the rotational center axis of the crankshaft and having the predetermined radius, while arranged to be mutually spaced apart at the predetermined angular intervals (equiangular intervals of approximately 60 degrees each). Then, the screw insertion holes of the flange portion of the output shaft are formed to be matched to the screw holes. However, the present invention is not restricted thereto, and the screw holes and the screw insertion holes may instead be positioned at positions deviating from a circumference such as that described above. The screw holes and the screw insertion holes are disposed so as to differ from the rotational center axis of the crankshaft in this case as well. The screw holes of the flange portion of the crankshaft and the screw insertion holes of the flange portion of the output shaft do not have to be positioned at equal intervals.

According to the first preferred embodiment, an example of applying the positioning pin that sets the position of the output shaft with respect to the crankshaft at a position separated by the predetermined distance from the rotational center axes of the crankshaft and the output shaft is preferably described as an example of the positioning structure of the present invention. However, the present invention is not restricted thereto. For example, an engaging hole or an engaging groove may be provided in one of either the crankshaft or the output shaft, and an engaging protrusion engageable with the engaging hole or the engaging groove may be provided in the other of either the crankshaft or the output shaft. Or, a key may be provided in one of either the crankshaft or the output shaft, and a key groove engageable with the key may be provided in the other of either the crankshaft or the output shaft.

In the first preferred embodiment and the second preferred embodiment, the stator unit is preferably fixed by screw members being screwed to the cylinder body and the crankcase. However, the stator unit may instead be fixed to the crankcase without being fixed to the cylinder body.

According to the second preferred embodiment, an example where the crankshaft and the output shaft are preferably fastened by two screw members was described. However, the present invention is not restricted thereto. For example, the crankshaft and the output shaft may be fastened by a single screw member or may be fastened by three or more screw members. In this case, the screw members are preferably disposed at equiangular intervals. The crankshaft and the output shaft may be fastened by a pin or a rivet, for example.

According to the second preferred embodiment, an example where the crankshaft and the output shaft are fastened in the fastening directions perpendicular or substantially perpendicular to the rotational center axis of the crankshaft was described. However, the present invention is not restricted thereto. A fastening direction in which the crankshaft and the output shaft are fastened may be a direction that intersects but is not perpendicular to the rotational center axis of the crankshaft.

Figure 16:
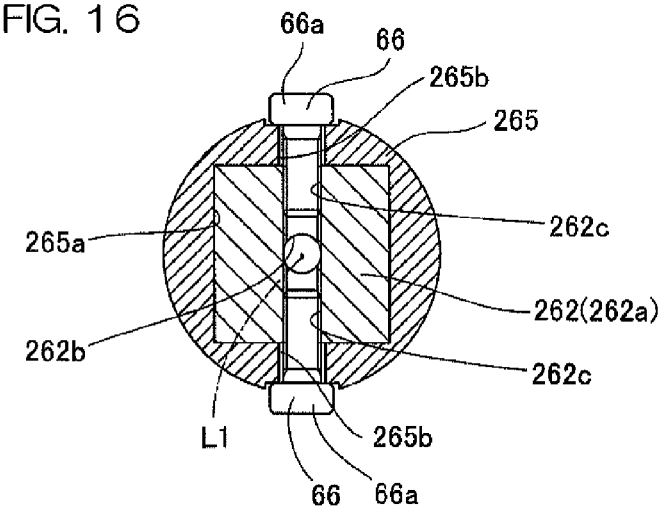
FIG. 16 is a sectional view of a state where a crankshaft and an output shaft of the water jet propulsion watercraft according to a modification example of the second preferred embodiment are fastened together.

In the second preferred embodiment, the protruding portion that protrudes cylindrically toward the rear is formed on the rear end portion of the crankshaft. Then, the recessed portion, engageable with the protruding portion of the crankshaft and having the circumferential inner peripheral surface of the same shape as the cylindrical shape of the protruding portion, is formed in the front end portion of the output shaft. However, the present invention is not restricted thereto. For example, a crankshaft 262 and an output shaft 265 shown in FIG. 16 may be used. As in this example, a protruding portion 262*a*, which protrudes rearward in a polygonal shape (for example, as a quadrangular prism), may be formed at the rear end portion of the crankshaft 262, and a recessed portion 265*a* of polygonal shape (for example, of rectangular shape) that is engageable with the protruding portion 262*a* of the crankshaft 262 may be provided at the front end portion of the output shaft 265.

The crankshaft 262 of the water jet propulsion watercraft according to the modification example of the second preferred embodiment has the protruding portion 262*a*, which protrudes rearward. The protruding portion 262*a* has an outer peripheral surface of polygonal shape (rectangular shape) when viewed from the direction of extension of the rotational center axis L1. The output shaft 265 has the recessed portion 265*a*. An inner peripheral surface of the recessed portion 265*a* is formed to a polygonal shape (rectangular shape) that is engageable with the protruding portion 262*a* of the crankshaft 262 when viewed from the direction of extension of the rotational center axis L1. Each screw member 66 passes through a screw insertion hole 265*b* of the output shaft 265 and is threadedly fixed in a screw hole 262*c* of the crankshaft 262. The crankshaft 262 and the output shaft 265 are thereby fastened. The screw insertion hole 265*b* is an example of the "screw insertion hole" according to a preferred embodiment of the present invention.

By arranging the water jet propulsion watercraft according to the modification example of the second preferred embodiment as described above, the protruding portion 262*a* of the crankshaft 262 and the recessed portion 265*a* of the output shaft 265 can be engaged so as not to run idle with respect to each other. The rotational force of the crankshaft 262 can thus be transmitted to the output shaft 265. By the above, transmission of power from the crankshaft 262 to the output shaft 265 via the engagement of the recessed portion 265*a* and the protruding portion 262*a* can be performed in addition to the transmission of power from the crankshaft 262 to the output shaft 265 via the screw members 66. A load (shear force) received by the screw members 66 during transmission of the rotation of the crankshaft 262 to the output shaft 265 can thereby be reduced, and the screw members 66 can thus be improved in durability.

According to the modification example of the second preferred embodiment, an example where the outer peripheral surface of the protruding portion of the crankshaft and the inner peripheral surface of the recessed portion of the output shaft are arranged as rectangular shapes was described. However, the present invention is not restricted thereto. For example, the outer peripheral surface of the protruding portion of the crankshaft and the inner peripheral surface of the recessed portion of the output shaft may be arranged as polygonal shapes besides rectangular shapes.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The present application corresponds to Japanese Patent Application No. 2008-248077 filed in the Japan Patent Office on Sep. 26, 2008, and the entire disclosure of the application is incorporated herein by reference.

What is claimed is:

1. A water jet propulsion watercraft comprising:

a main engine body;

a rotor chamber provided at a rear portion of the main engine body;

a crankshaft arranged such that a rear end portion of the crankshaft is disposed in the rotor chamber, the rear end portion having a first connection portion;

an output shaft including a second connection portion at a front end portion of the output shaft, the second connection portion arranged to be connected to the first connection portion of the crankshaft such that the output shaft rotates together with the crankshaft about a rotational center axis of the crankshaft;

a rotor unit housed in the rotor chamber and fixed to the output shaft;

a fastening member arranged to fasten the first connection portion and the second connection portion along a fastening axis that differs from the rotational center axis, a drive shaft connected to a rear end portion of the output shaft and arranged to be rotated together with the output shaft; and a jet propulsion unit including an impeller coupled to the drive shaft and arranged to suck in and jet out water.

2. The water jet propulsion watercraft according to claim 1, wherein the second connection portion of the output shaft includes a flange portion arranged to contact the first connection portion of the crankshaft.

3. The water jet propulsion watercraft according to claim 2, wherein the rotor unit is fixed to the flange portion of the output shaft.

4. The water jet propulsion watercraft according to claim 2, wherein the first connection portion of the crankshaft includes a flange portion arranged to contact the flange portion of the output shaft.

5. The water jet propulsion watercraft according to claim 4, further comprising:

a stator unit arranged to surround an outer peripheral portion of the crankshaft inside the rotor chamber and disposed so as to overlap with the flange portion of the crankshaft when viewed from a direction perpendicular or substantially perpendicular to the crankshaft; and a rotor unit fixed to the flange portion of the output shaft, and arranged to extend to the crankcase side of the main engine body, and to cover an outer peripheral portion of the stator unit.

6. The water jet propulsion watercraft according to claim 1, wherein a plurality of the fastening members are disposed along a circumference of predetermined radius, centered on the rotational center axis of the crankshaft, and spaced apart at predetermined intervals.

7. The water jet propulsion watercraft according to claim 1, wherein a screw hole is provided in the first connection portion of the crankshaft, a screw insertion hole is provided in the second connection portion of the output shaft, and the fastening member includes a screw member arranged to pass through the screw insertion hole and to be threadedly fixed in the screw hole.

8. The water jet propulsion watercraft according to claim 1, further comprising:

a positioning structure, disposed at a position spaced at a predetermined distance from the rotational center axis of the crankshaft, and arranged to restrict relative rotations of the first connection portion and the second connection portion about the rotational center axis to set a position of the output shaft with respect to the crankshaft.

9. The water jet propulsion watercraft according to claim 1, further comprising:

a recessed portion provided on one of the rear end portion of the crankshaft and the front end portion of the output shaft; and a protruding portion provided on the other one of the rear end portion of the crankshaft and the front end portion of the output shaft and arranged to fit with the recessed portion; wherein central axes of the recessed portion and the protruding portion are matched with the rotational center axis.

10. The water jet propulsion watercraft according to claim 1, further comprising:

a stator unit arranged to surround an outer peripheral portion of the crankshaft inside the rotor chamber; wherein the main engine body includes a crankcase arranged to house a portion of the crankshaft; and the stator unit is attached to the crankcase.

11. The water jet propulsion watercraft according to claim 1, further comprising:

a starter motor arranged to be driven when the engine is started;

a first gear arranged to output a driving force of the starter motor;

a second gear coupled to the first gear in a manner enabling constant transmission of power and arranged to transmit the driving force of the starter motor to the output shaft; and a one-way clutch disposed between the output shaft and the second gear and arranged to make the second gear run idle with respect to the output shaft such that the driving force of the output shaft is not transmitted to the second gear while the engine is running.

12. The water jet propulsion watercraft according to claim 11, wherein the second connection portion of the output shaft includes a flange portion having a front end that is arranged to contact the first connection portion of the crankshaft, and the one-way clutch is fixed to a rear surface of the flange portion of the output shaft.

13. The water jet propulsion watercraft according to claim 11, wherein the crankshaft includes a first oil passage portion through which oil flows, and the output shaft includes a second oil passage portion connected to the first oil passage portion and arranged to supply the oil to the one-way clutch.

14. The water jet propulsion watercraft according to claim 1, wherein the fastening member is arranged to fasten the first connection portion and the second connection portion in a fastening direction that intersects the rotational center axis of the crankshaft.

15. The water jet propulsion watercraft according to claim 14, wherein the first connection portion and the second connection portion overlap when viewed from a direction perpendicular or substantially perpendicular to the crankshaft, and the fastening member is arranged to fasten the overlapping portions of the first connection portion and the second connection portion to each other.

16. The water jet propulsion watercraft according to claim 15, wherein:

the crankshaft includes an oil passage portion provided along the rotational center axis;

the fastening member includes a screw member;

the second connection portion of the output shaft includes a bearing surface portion arranged to receive the screw member, and a screw insertion hole opening at the bearing surface portion;

the first connection portion of the crankshaft includes a screw hole arranged to engage with the screw member passing through the screw insertion hole; and a tip portion of the screw member is arranged so as not to reach the oil passage portion.

17. The water jet propulsion watercraft according to claim 15, wherein one of either of the first connection portion and the second connection portion includes a recessed portion, the other of the first connection portion and the second connection portion includes a protruding portion arranged to fit with the recessed portion, and the recessed portion and the protruding portion are fitted together along the rotational center axis.

18. The water jet propulsion watercraft according to claim 17, wherein the protruding portion has an outer peripheral surface having a polygonal shape when viewed from a direction extending along the rotational center axis, and the recessed portion has an inner peripheral surface having a polygonal shape arranged to engage with the outer peripheral surface of the protruding portion when viewed from the direction extending along the rotational center axis.

19. The water jet propulsion watercraft according to claim 14, further comprising:

a flange member disposed at an outer peripheral surface portion of the output shaft inside the rotor chamber, and to which the rotor unit is attached; and a flange fastening member arranged to fasten the flange member to the output shaft; wherein the flange fastening member is arranged to fasten the flange member and the output shaft along a direction directed from the outer peripheral surface portion to the rotational center axis.

20. The water jet propulsion watercraft according to claim 1, wherein the second connection portion at the front end portion of the output shaft is directly connected to the first connection portion of the crankshaft such that the output shaft rotates together with the crankshaft about the rotational center axis of the crankshaft.

* * * * *